US007909094B2

(12) United States Patent
Schultz et al.

(10) Patent No.: US 7,909,094 B2
(45) Date of Patent: Mar. 22, 2011

(54) OSCILLATING FLUID FLOW IN A WELLBORE

(75) Inventors: Roger L. Schultz, Ninnekah, OK (US); Travis W. Cavender, Angleton, TX (US); Robert L. Pipkin, Marlow, OK (US); Daniel D. Gleitman, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 234 days.

(21) Appl. No.: 12/120,633

(22) Filed: May 14, 2008

(65) Prior Publication Data

US 2009/0008088 A1 Jan. 8, 2009

Related U.S. Application Data

(60) Provisional application No. 60/948,346, filed on Jul. 6, 2007.

(51) Int. Cl.
*E21B 28/00* (2006.01)
*E21B 43/24* (2006.01)

(52) U.S. Cl. ..... 166/249; 166/303; 166/272.3; 166/177.2; 137/833; 137/835

(58) Field of Classification Search ..... 166/249, 166/312, 303, 177.2, 272.3, 177.1, 177.6; 137/833, 835
See application file for complete search history.

(56) References Cited

U.S. PATENT DOCUMENTS 1,890,212 A 12/1932 Bridgham
3,133,591 A 5/1964 Brandon
3,190,388 A 6/1965 Moser et al.
3,610,347 A * 10/1971 Diamantides et al. ..... 175/56
3,804,172 A * 4/1974 Closmann et al. ..... 166/272.3
3,850,135 A 11/1974 Galle
4,243,098 A 1/1981 Meeks et al.
4,345,650 A 8/1982 Wesley
4,429,748 A 2/1984 Beck
4,448,269 A * 5/1984 Ishikawa et al. ..... 175/335
4,479,204 A 10/1984 Silverman (Continued)

FOREIGN PATENT DOCUMENTS

WO WO 99/02819 1/1999

(Continued)

OTHER PUBLICATIONS

Vinegar et al., U.S. Provisional Application entitled "In Situ Energy Recovery," U.S. Appl. No. 60/199,215, filed Apr. 24, 2000, 29 pages.

(Continued)

*Primary Examiner* — Giovanna C Wright
(74) *Attorney, Agent, or Firm* — Joshua A. Griswold

(57) ABSTRACT

A system for oscillating compressible working fluid in a wellbore defined in a subterranean formation includes a fluid supply and a fluid oscillator device. The fluid supply communicates compressible working fluid into a conduit disposed within the wellbore. The fluid oscillator device is configured to reside in the wellbore. The fluid oscillator device includes an interior surface that defines an interior volume of the fluid oscillator device, an inlet into the interior volume, and an outlet from the interior volume. The interior surface is static during operation to receive the compressible working fluid into the interior volume through the inlet and to vary over time a flow rate of the compressible working fluid from the interior volume through the outlet.

34 Claims, 21 Drawing Sheets

U.S. PATENT DOCUMENTS 4,633,952 A 1/1987 Ringgenberg
4,687,491 A 8/1987 Latty
4,783,585 A 11/1988 Meshekow
4,930,454 A 6/1990 Latty et al.
5,036,945 A 8/1991 Hoyle et al.
5,142,608 A 8/1992 Meshekow
5,184,678 A 2/1993 Pechkov et al.
5,228,508 A * 7/1993 Facteau et al. ..... 166/177.2
5,229,553 A 7/1993 Lester et al.
5,510,582 A 4/1996 Birchak et al.
5,623,576 A 4/1997 Deans
5,886,255 A 3/1999 Aronstam
5,950,726 A 9/1999 Roberts
5,984,578 A 11/1999 Hanesian et al.
6,082,484 A 7/2000 Molz et al.
6,227,293 B1 5/2001 Huffman et al.
6,456,566 B1 9/2002 Aronstam
6,478,107 B1 11/2002 Birchak et al.
6,504,258 B2 1/2003 Schultz et al.
6,581,684 B2 6/2003 Wellington et al.
6,588,503 B2 7/2003 Karanikas et al.
6,588,504 B2 7/2003 Wellington et al.
6,591,906 B2 7/2003 Wellington et al.
6,591,907 B2 7/2003 Zhang et al.
6,607,033 B2 8/2003 Wellington et al.
6,609,570 B2 8/2003 Wellington et al.
6,619,394 B2 9/2003 Soliman et al.
6,662,899 B2 12/2003 Norris et al.
6,688,387 B1 2/2004 Wellington et al.
6,698,515 B2 3/2004 Karanikas et al.
6,702,016 B2 3/2004 de Rouffignac et al.
6,708,758 B2 3/2004 de Rouffignac et al.
6,712,135 B2 3/2004 Wellington et al.
6,712,136 B2 3/2004 de Rouffignac et al.
6,712,137 B2 3/2004 Vinegar et al.
6,712,160 B1 3/2004 Schultz et al.
6,715,546 B2 4/2004 Vinegar et al.
6,715,547 B2 4/2004 Vinegar et al.
6,715,548 B2 4/2004 Wellington et al.
6,715,549 B2 4/2004 Wellington et al.
6,719,047 B2 4/2004 Fowler et al.
6,722,429 B2 4/2004 de Rouffignac et al.
6,722,430 B2 4/2004 Vinegar et al.
6,722,431 B2 4/2004 Karanikas et al.
6,725,920 B2 4/2004 Zhang et al.
6,725,921 B2 4/2004 de Rouffignac et al.
6,725,928 B2 4/2004 Vinegar et al.
6,729,395 B2 5/2004 Shahin, Jr. et al.
6,729,396 B2 5/2004 Vinegar et al.
6,729,397 B2 5/2004 Zhang et al.
6,729,401 B2 5/2004 Vinegar et al.
6,732,794 B2 5/2004 Wellington et al.
6,732,795 B2 5/2004 de Rouffignac et al.
6,732,796 B2 5/2004 Vinegar et al.
6,736,215 B2 5/2004 Maher et al.
6,739,393 B2 5/2004 Vinegar et al.
6,739,394 B2 5/2004 Vinegar et al.
6,742,587 B2 6/2004 Vinegar et al.
6,742,588 B2 6/2004 Wellington et al.
6,742,589 B2 6/2004 Berchenko et al.
6,742,593 B2 6/2004 Vinegar et al.
6,745,831 B2 6/2004 de Rouffignac et al.
6,745,832 B2 6/2004 Wellington et al.
6,745,837 B2 6/2004 Wellington et al.
6,749,021 B2 6/2004 Vinegar et al.
6,752,210 B2 6/2004 de Rouffignac et al.
6,758,268 B2 7/2004 Vinegar et al.
6,761,216 B2 7/2004 Vinegar et al.
6,763,886 B2 7/2004 Schoeling et al.
6,768,214 B2 7/2004 Schultz et al.
6,769,483 B2 8/2004 de Rouffignac et al.
6,769,485 B2 8/2004 Vinegar et al.
6,778,918 B2 8/2004 Delhomme et al.
6,789,625 B2 9/2004 de Rouffignac et al.
6,795,373 B1 9/2004 Aronstam
6,805,195 B2 10/2004 Vinegar et al.
6,820,688 B2 11/2004 Vinegar et al.
6,834,743 B2 12/2004 Arian et al.
6,848,503 B2 2/2005 Schultz et al.
6,866,097 B2 3/2005 Vinegar et al.
6,871,707 B2 3/2005 Karanikas et al.
6,877,554 B2 4/2005 Stegemeier et al.
6,880,635 B2 4/2005 Vinegar et al.
6,889,769 B2 5/2005 Wellington et al.
6,896,053 B2 5/2005 Berchenko et al.
6,902,003 B2 6/2005 Maher et al.
6,902,004 B2 6/2005 de Rouffignac et al.
6,910,536 B2 6/2005 Wellington et al.
6,913,078 B2 7/2005 Shahin, Jr. et al.
6,923,258 B2 8/2005 Wellington et al.
6,948,563 B2 9/2005 Wellington et al.
6,953,087 B2 10/2005 de Rouffignac et al.
6,959,761 B2 11/2005 Berchenko et al.
6,966,372 B2 11/2005 Wellington et al.
6,973,967 B2 12/2005 Stegemeier et al.
6,991,031 B2 1/2006 Vinegar et al.
6,994,160 B2 2/2006 Wellington et al.
6,994,161 B2 2/2006 Maher et al.
6,994,168 B2 2/2006 Wellington et al.
6,997,255 B2 2/2006 Wellington et al.
6,998,999 B2 2/2006 Fripp et al.
7,011,154 B2 3/2006 Maher et al.
7,017,661 B2 3/2006 Vinegar et al.
7,036,583 B2 5/2006 de Rouffignac et al.
7,086,468 B2 8/2006 de Rouffignac et al.
7,096,941 B2 8/2006 de Rouffignac et al.
7,096,953 B2 8/2006 de Rouffignac et al.
7,147,057 B2 12/2006 Steele et al.
2002/0027001 A1 3/2002 Wellington et al.
2002/0029885 A1 3/2002 de Rouffignac et al.
2002/0033253 A1 3/2002 Rouffignac et al.
2002/0035307 A1 3/2002 Vinegar et al.
2002/0036089 A1 3/2002 Vinegar et al.
2002/0038069 A1 3/2002 Wellington et al.
2002/0040779 A1 4/2002 Wellington et al.
2002/0040780 A1 4/2002 Wellington et al.
2002/0040781 A1 4/2002 Keedy et al.
2002/0049360 A1 4/2002 Wellington et al.
2002/0053431 A1 5/2002 Wellington et al.
2002/0076212 A1 6/2002 Zhang et al.
2003/0042018 A1 3/2003 Huh et al.
2003/0066642 A1 4/2003 Wellington et al.
2003/0075318 A1 4/2003 Keedy et al.
2003/0085034 A1 5/2003 Wellington et al.
2004/0112594 A1 6/2004 Aronstam et al.
2005/0051327 A1 3/2005 Vinegar et al.
2005/0087391 A1 4/2005 Ounadjela
2005/0214147 A1 * 9/2005 Schultz et al. ..... 417/503
2005/0239661 A1 10/2005 Pfefferle
2006/0037746 A1 2/2006 Wright et al.
2006/0042794 A1 3/2006 Pfefferle
2006/0108111 A1 5/2006 Kas'yanov
2006/0260814 A1 11/2006 Pfefferle
2007/0187093 A1 8/2007 Pfefferle
2007/0187094 A1 8/2007 Pfefferle
2007/0199712 A1 * 8/2007 Hocking ..... 166/303
2008/0083536 A1 4/2008 Cavender et al.
2009/0008090 A1 1/2009 Schultz et al.
2009/0008096 A1 1/2009 Schultz et al.
2009/0277639 A1 11/2009 Schultz et al.

FOREIGN PATENT DOCUMENTS

WO WO 2009/009437 1/2009

OTHER PUBLICATIONS

International Search Report and Written Opinion for PCT/US2008/069225, Jan. 28, 2009, 13 pages.

International Search Report and Written Opinion for PCT/US2008/069137, Mar. 10, 2010, 15 pages.

Mathisen, M.E. et al., "Crosswell Seismic Radial Survey Tomograms and the 3-D Interpretation of a Heavy Oil Steamflood", Geophysics, vol. 60, No. 3, May 1, 1995, 9 pages.

SPE paper 84848, Hanzlik, E., Mims, D.: 40 Years of Steam Injection in California Evolution of Heat Management (2003). (8 pages).

"Hydrogen production through an ocean thermal energy conversion system operating at an optimum temperature drop" Applied Thermal Engineering, vol. 25, Issues 14-15, pp. 2236-2246, Oct. 2005.
Contractor Report, SAND82-7008, "Downhole Steam Generator Study vol. I—Conception and Feasibility Evaluation," Sandia National Laboratories, United States Department of Energy Contract DE-AC04-76DP00789, Jun. 1982, 252 pages.
A.J. Mulac, et al., SAND80-2843, Project Deep Staem Preliminary Field Test, Bakersfield, California, Printed Apr. 1981, 62 pages.
A.B. Donaldson, "Reflections on a Downhole Steam Generator Program," SPE 38276, Society of Petroleum Engineers, Copyright 1997, pp. 227-236 (10 pages).
J.M. Friefeld, et al., "Field Test of a Direct-Fired Downhole Steam Generator," Rocketdyne report, Rockwell International, 14 pages.
Fresno State News.com, "New Oil Technology Answers Old Air Problems," John Donohue and Dr. Andrew Hoff, Oct. 20, 2005, 3 pages.
Downhole Combustor/Steam Generator for Oil and Gas Production, URL: http://www.precision-combustion.com/fossilfuelproductionproducts.html, Copyright 2001-2008, Precision Combustion, Inc., printed Jan. 15, 2009, 1 page.
CGG Veritas, Seismic Overview, URL: http://www.cggveritas.com/default.aspx?cid=24&lang=1, copyright 2008, printed Jun. 20, 2008 (41 pages).
JPT: Frontiers of Technology—Seismic Technology Jan. 1999, URL: http://www.spe.org/spe-app/spe/jpt/1999/02/frontiers_seismic.htm, vol. 2, Feb. 1999, printed Jun. 20, 2008 (5 pages).
4D Definitions—Time-lapse (4D) seismic technology, Western Geco, URL: http://www.westerngeco.com/content/services/4d/definitions.asp, copyright 2008, printed Jun. 20, 2008 (1 page).
WorldOil.com—Online Magazine Article: Special Focus—Nov. 1998, Using 4-D seismic to monitor and improve steamflood efficiency, URL: http://www.worldoil.com/magazine/MAGAZINE_DETAIL.asp?ART_ID=565&MONTH_YEAR=Nov. 1998, vol. 219, No. 11, printed Jun. 20, 2008 (4 pages).
Pascal Breton, et al., "Well-Positioning Seismic Measurements," Oilfield Review, URL: http://www.s1b.com/media/services/resources/oilfieldreview/ors02/spr02/p32_45.pdf, Spring 2002 (14 pages).
Richard Meehan, Rekindling Interest in Seismic While Drilling, Oilfield Review, URL: http://www.slb.com/media/services/resources/oilfieldreview/ors93/0193/p04_13.pdf, Jan. 1993 (10 pages).
VSFusion—Applications, Time-Depth Correlation, Service: Velocity or Checkshot Survey, URL: http://www.vsfusion.com/application/app.htm, copyright 2007, printed Jun. 20, 2008 (1 page).
Surface Seismic AVO Callibration, Service: Walkaway VSP, 3D VSP, URL: http://www.vsfusion.com/application/app_surface.htm, VSFusion—Applications, copyright 2007, printed Jun. 20, 2008 (1 page).
Information regarding date of availability of previously-cited 41-page document entitled "CGG Veritas, Seismic Overview" (see Desig. ID 70 of Form PTO-1449 filed Jun. 22, 2010), URL: http://web.archive.org/web/20070912160149/http://www.cggveritas.com/default.aspx?cid=24&lang=1, bearing a date of Sep. 12, 2007, 1 page.
Schirmer, Robert M. et al., Document Preview, "A Direct-Fired Downhole Steam Generator-From Design to Field Test", Journal of Petroleum Technology, vol. 37, No. 10, Oct. 1985, p. 1903. Printed from URL: http://www.onepetro.org/mslib.servlet/onepetropreview?=00010705&soc=SPE on Jul. 8, 2010. (1 page).
USPTO File for U.S. Appl. No. 12/667,978, which is a national stage of PCT/US2008/069225 filed Jul. 3, 2008, entitled "Detecting Acoustic Signals from a Well System", 176 pages.

* cited by examiner

OSCILLATING FLUID FLOW IN A WELLBORE

CROSS-REFERENCE TO RELATED APPLICATIONS

This application is related to and claims the benefit of provisional application Ser. No. 60/948,346 entitled "DOWNHOLE COMBUSTION AND STEAM GENERATION," filed Jul. 6, 2007, which is incorporated herein by reference.

BACKGROUND

The present disclosure relates to oscillating fluid flow in a wellbore.

Heat transfer fluid (e.g., steam and/or others) can be injected into a subterranean formation to facilitate production of fluids from the formation. For example, steam may be used to reduce the viscosity of fluid resources in the formation, so that the resources can more freely flow into a wellbore and to the surface.

SUMMARY

A system for oscillating working fluid in a wellbore includes a fluid supply and a fluid oscillator device. The fluid oscillator device receives the working fluid into an interior volume of the fluid oscillator device and varies over time a flow rate of the compressible working fluid through an outlet of the fluid oscillator device.

In certain aspects, a system for oscillating compressible working fluid in a wellbore defined in a subterranean formation includes the fluid supply and the fluid oscillator device. The fluid supply communicates compressible working fluid into a conduit disposed within the wellbore. The fluid oscillator device is configured to reside in the wellbore. The fluid oscillator device includes an interior surface that defines an interior volume of the fluid oscillator device, an inlet into the interior volume, and an outlet from the interior volume. The interior surface is static during operation to receive the compressible working fluid into the interior volume through the inlet and to vary over time a flow rate of the compressible working fluid from the interior volume through the outlet.

In certain aspects, compressible working fluid is directed through at least a portion of the wellbore defined in the subterranean formation and into a fluid oscillator device installed in the wellbore. At least a first portion of the compressible working fluid is directed within the fluid oscillator device to perturb a flow of at least a second portion of the compressible working fluid within the fluid oscillator device. At least a portion of the compressible working fluid is directed out of the fluid oscillator device at a flow rate that varies over time.

In certain aspects, a working fluid that includes a liquid is directed through at least a portion of the wellbore defined in the subterranean formation and into a fluid oscillator device installed in the wellbore. At least a portion of the liquid is vaporized to form a compressible working fluid. At least a portion of the compressible working fluid is directed out of the fluid oscillator at a flow rate that varies over time.

Implementations can include one or more of the following features. The compressible working fluid includes heat transfer fluid. The fluid supply includes a heat transfer fluid generator configured to reside in the wellbore. The fluid supply includes a heat transfer fluid generator configured to reside above a ground surface outside of the wellbore. The compressible working fluid includes steam of less than one hundred percent quality. The system includes a conduit in fluid communication with each of the at least one outlets. Each conduit is configured to inject the compressible working fluid into the subterranean formation. The outlet is a first outlet, and the fluid oscillator device further includes a second outlet. The interior surface is configured to alternate a flow of compressible working fluid between the first outlet and the second outlet. A first portion of the interior surface defines a chamber, a third outlet from the chamber into a first feedback channel, and a fourth outlet from the chamber into a second feedback channel. A second portion of the interior surface defines the first feedback channel and the first outlet extending from the first feedback channel. A third portion of the interior surface defines the second feedback channel and the second outlet extending from the second feedback channel. The inlet is configured to direct the compressible working fluid into the chamber. The first and second feedback channels are each configured to direct at least a portion of the compressible working fluid toward a region in the chamber near the inlet. The chamber is a first chamber, and a fourth portion of the interior surface defines a second chamber extending from the first chamber. The second chamber is configured to receive at least a portion of the compressible working fluid from the first chamber and to direct at least a portion of the received compressible working fluid back into the first chamber. The conduit is an outer conduit, and the system further includes an inner conduit disposed within the outer conduit. The fluid oscillator device is configured to receive compressible working fluid from an annulus between the outer conduit and the inner conduit. The fluid supply includes a steam generator. The compressible working fluid includes at least one of air, steam, nitrogen gas, carbon dioxide gas, carbon monoxide gas, natural gas, or another compressible fluid. The interior surface defines a resonant chamber that is static during operation to vary over time a pressure of the compressible working fluid in the interior volume. The fluid oscillator device includes a whistle. The system further includes a hydrocyclone device configured to receive a mixture of compressible working fluid and condensed fluid from the conduit, separate at least a portion of the condensed fluid from a remainder of the mixture, and communicate the remainder of the mixture into the inlet of the whistle. The system further includes a tapered insert defining at least a portion of the interior volume of the whistle and a tapered slot to receive the tapered insert. The received portion of compressible working fluid is injected into the subterranean formation. Injecting the received portion of compressible working fluid into the subterranean formation includes stimulating a flow of resources through the subterranean formation. Injecting the received portion of compressible working fluid into the subterranean formation includes reducing a viscosity of resources in the subterranean formation. The wellbore is a first wellbore and injecting the received portion of compressible working fluid into the subterranean formation includes stimulating a flow of resources through the formation into a second wellbore defined in the subterranean formation. A portion of the compressible working fluid is periodically compressed within the fluid oscillator device. Sound waves are propagated through the subterranean formation. The sound waves are generated by the periodic compression of the compressible working fluid in the fluid oscillator device. The flow rate varies in a periodic manner over time. Directing at least a first portion of the compressible working fluid within the fluid oscillator device to perturb a flow of at least a second portion of the compressible working fluid within the fluid oscillator device includes directing at least the first portion of the compressible working fluid within the fluid oscillator device to perturb a direction of the flow of at least the second portion of the compressible working fluid within the fluid oscillator device. Vaporizing at least a portion of the liquid includes reducing the pressure of the liquid to induce a liquid to gas phase change of the liquid working fluid. The liquid includes condensed water and the compressible working fluid includes steam.

The details of one or more implementations are set forth in the accompanying drawings and the description below. Other features will be apparent from the description and drawings, and from the claims.

DESCRIPTION OF DRAWINGS

FIGS. 3A-3D are detail views of an example steam oscillator sub of FIG. 2, wherein FIG. 3A is a perspective view, FIG. 3B is a side cross-sectional view, FIG. 3C is a cross-sectional view along line 3C-3C of FIG. 3B, and FIG. 3D is an bottom end view.

FIGS. 3E-3H are detail views of an example steam oscillator sub of FIG. 2, wherein FIG. 3E is a perspective view, FIG. 3F is a side cross-section view, FIG. 3G is a cross-sectional view along line 3G-3G of FIG. 3F, and FIG. 3H is an bottom end view.

FIGS. 3I-3L are detail views of an example steam oscillator sub of FIG. 2, wherein FIG. 3I is a perspective view, FIG. 3J is a side view, FIG. 3K is a side cross-sectional view along line 3K-3K of FIG. 3J, and FIG. 3L is a side cross-sectional view along line 3L-3L of FIG. 3J.

FIGS. 3M-3Q are views of an example steam oscillator device, wherein FIG. 3M is a perspective view, FIG. 3N is a side cross-sectional view, FIG. 3O is a top end view, FIG. 3P is a bottom end view, and FIG. 3Q is a side cross-sectional view along line 3Q-3Q of FIG. 3N.

FIGS. 4A-4D are detail views of an example whistle assembly, wherein FIG. 4A is a perspective view including a partial cross-section, FIG. 4B is a side view, FIG. 4C is a side cross-sectional view along line 4C-4C of FIG. 4B, and FIG. 4D is an end view.

FIGS. 4I-4L are views of an example steam oscillator system, wherein FIG. 4I is a side cross-sectional view, FIG. 4J is an end cross-sectional view along line 4I-4J of FIG. 4I, FIG. 4K is an end cross-sectional view along line 4K-4K of FIG. 4I, and FIG. 4L is an end cross-sectional view along line 4L-4L of FIG. 4I.

Like reference symbols in the various drawings indicate like elements.

DETAILED DESCRIPTION

Figure 1A:
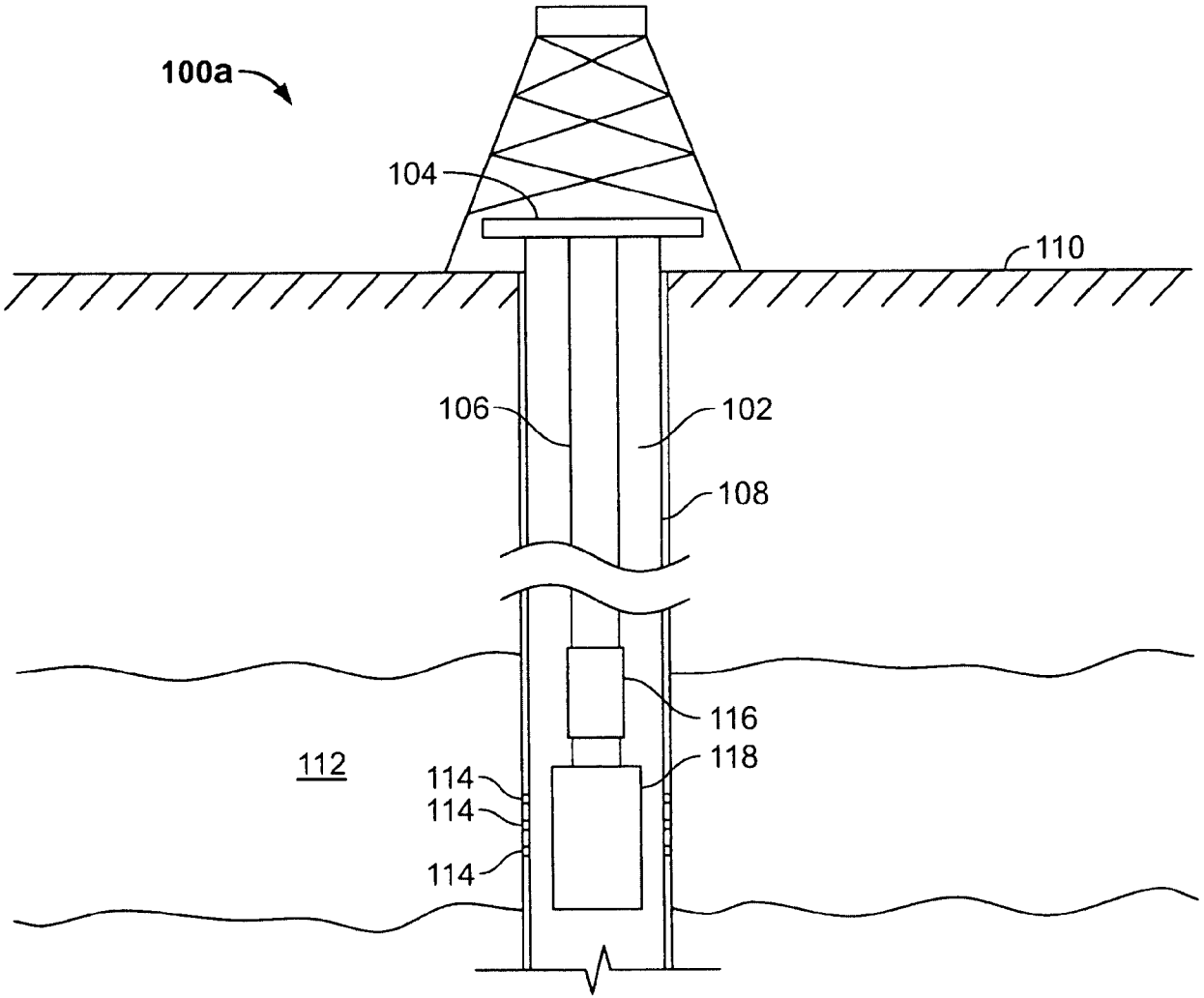
FIGS. 1A and 1B are schematic, side cross-sectional views of example well systems.

The present disclosure relates to oscillating fluid flow in a wellbore. In some implementations, the fluid includes compressible working fluid introduced into a subterranean zone through a wellbore. For example, the fluid may be provided (e.g. injected) into a subterranean zone to reduce the viscosity of in-situ resources and increase flow of the resources through the subterranean zone to one or more well bores. In some implementations, the fluid includes heat transfer fluid used in huff and puff, steam assisted gravity drainage (SAGD), steam flood, or other operations. In some implementations, oscillation of compressible working fluid within the wellbore may generate compression waves, for example. Sound waves. In some cases, the compression waves can be used to stimulate production from the subterranean zone. The subterranean zone can include all or a portion of a resource-bearing subterranean formation, multiple resource-bearing subterranean formations, and/or other types of formations.

Example fluids include heat transfer fluid, compressible fluid, non-compressible fluid, other types of fluids, and mixtures thereof. In some implementations, the fluid includes a mixture of an incompressible fluid and compressible fluid, for example, as a mist, foam, or other mixture. Example compressible fluids include air, carbon monoxide (CO), carbon dioxide ($CO_2$), molecular nitrogen gas ($N_2$), natural gas, molecular oxygen ($O_2$)-enriched or vitiated air, natural gas, steam, and others. In some cases, the compressible working fluid communicated into the wellbore is entirely composed of one of the example compressible fluids listed above. In some cases, the compressible working fluid communicated into the wellbore is substantially entirely (e.g., 98%, 99%, or more) or partially (e.g., 80%) composed of one of the example compressible working fluids above. In some cases, the compressible working fluid communicated into the wellbore is substantially entirely composed of one of the example compressible working fluids above and some contaminates. Heat transfer fluid may take the form of vapor and/or gas, alone or with some condensed liquid, and may include water, carbon monoxide and other combustion byproducts (e.g. from a heated fluid generator and/or other surface and downhole equipment) and/or other fluids. In some cases, heat transfer fluid may include steam, liquid water, diesel oil, gas oil, molten sodium, and/or synthetic heat transfer fluids. Example synthetic heat transfer fluids include THERMINOL 59 heat transfer fluid which is commercially available from Solutia, Inc., MARLOTHERM heat transfer fluid which is commercially available from Condea Vista Co., SYLTHERM and DOWTHERM heat transfer fluids which are commercially available from The Dow Chemical Company, and others. For convenience of reference, the concepts herein are described with reference to steam. However, the concepts herein, including the specific examples and implementations, are applicable to other heat transfer fluids.

An example implementation includes SAGD, which can be implemented in a well system that includes two or more horizontal wellbores defined in a subterranean formation, wherein an upper wellbore is defined above a lower wellbore. The lower well bore is completed for production (e.g., having a completion string that may include slotted tubulars, sand screens, packers, one or more production strings and/or other completion components) and, in some instances, includes a fluid lift system (e.g., electric submersible pump, progressive cavity pump, rod sucker pump, gas lift system, and/or other fluid lift system) for producing resources of the subterranean formation to the surface. Steam is injected into the subterranean formation through the upper wellbore, and resources are collected from the subterranean formation through the lower wellbore. The steam may stimulate gravity-induced flow of resources into the lower wellbore, and the resources can be produced to the surface. Another example implementation includes steam flood production, which can be implemented in a well system that includes two or more wellbores defined in a subterranean formation. In some cases, both wellbores are substantially vertical wellbores. Steam is injected into the subterranean formation through a first wellbore, and resources are collected from a second wellbore. The second well bore is completed for production and, in some instances, includes a fluid lift system. The injection of steam from the first wellbore creates a pressure gradient across the subterranean formation. For example, the pressure in the formation may be higher in a region proximate the first wellbore than in a region proximate the second wellbore. The pressure gradient may stimulate production of resources from the formation by causing the resources to flow to the lower pressure region and into the second wellbore, and the resources can be produced to the surface. Another example implementation includes huff and puff production, which can be implemented in a well system that includes one or more wellbores defined in a subterranean formation. During a first time period, steam is injected into the subterranean formation through a wellbore, and during a second, subsequent time period, resources are produced from the formation through the same or a different wellbore. The process of injecting steam into the formation and collecting resources from the formation may be repeated in a cyclic manner. The wellbore can be completed for production and, in some instances, include a fluid lift system when the resources are being produced to the surface. In some instances, the wellbore completion can accommodate both production and steam injection.

FIG. 1A is a diagram illustrating an example well system 100*a*. The example well system 100*a* includes a wellbore 102 defined in a subterranean region below a terranean surface 110. The wellbore 102 is cased by a casing 108, which may be cemented in the wellbore 102. In some cases, the wellbore may be an open hole wellbore 102, without the casing 108. The illustrated wellbore 102 is a vertical wellbore. However, in some implementations, a wellbore includes horizontal, curved, and/or slanted sections.

The well system 100*a* includes a working string 106 configured to reside in the wellbore 102. The working string 106 includes a tubular conduit configured to transfer materials into and/or out of the wellbore 102. For example, the working string 106 can communicate fluid (e.g., steam, another type of heat transfer fluid, and/or another working fluid) into or through a portion of the wellbore 102. The working string 106 can be in fluid communication with a fluid supply source. The fluid supply source can reside on a terranean surface and/or at another location outside of the well (e.g., on a platform, rig, boat and/or other location) and be at and/or remote from the well site. Alternately, or additionally, the fluid supply source can reside downhole. Example fluid supply sources include a steam generator, a surface and/or downhole compressor, a surface and/or downhole boiler, an internal combustion engine or other surface and/or downhole combustion device, a natural gas or other pipeline, and/or a surface and/or downhole fluid tank (in some instances pressurized). One or more parameters of the fluid flow can be controlled at or downstream from the fluid supply source, for example, by increasing or decreasing compression or combustion rates, adjusting a composition of the fluid, and/or adjusting flow rates (e.g., by use of valves, vents, and/or restriction devices). Example parameters of the fluid flow that may be adjusted include the volumetric flow rate, the mass flow rate, and/or others. As another example, the working string 106 can additionally transfer resources to the surface 110. Example resources include oil, natural gas, coal bed methane, and others types of materials that may be produced from the zone of interest 112 and/or another region. In some implementations, the working string includes jointed tubing, coiled tubing, and/or other types of tubing.

A number of different tools are provided in and/or attached to the working string 106. In FIG. 1A, a downhole fluid supply system may be provided. The system 100*a* includes a steam oscillator system 118. The illustrated working string 106 includes a steam generator 116 in fluid communication with the steam oscillator system 118. The steam generator 116 is a downhole fluid supply system which can be installed in the wellbore 102. The example steam generator 116 includes input feeds to receive input fluid from the surface. The example steam generator 116 heats the input fluid to produce steam and/or to heat another type of heat transfer fluid. In some implementations, heat is provided through one or more of a combustion process (e.g., combustion of fuel and oxygen), a non-combustion chemical process, electrical heating, and/or others. Some examples of steam generators (down hole or surface based) that can be used in accordance with the concepts described herein include electric type steam generators (see, e.g., U.S. Pat. Nos. 5,623,576, 4,783,585, and/or others), combustor type steam generators (see, e.g., Downhole Steam Generation Study Volume I, SAND82-7008, and/or others), catalytic type steam generators (see, e.g., U.S. Pat. Nos. 4,687,491, 4,950,454, U.S. Pat. Pub. Nos. 2006/0042794 2005/0239661 and/or others), and/or other types of steam generators (see, e.g. Downhole Steam Generation Study Volume I, SAND82-7008, discloses several different types of steam generators).

Some implementations include additional or different downhole fluid supply systems. In some cases, a downhole fluid supply system provides an increase in volumetric flow rate at the exit of the downhole fluid supply system as compared to the volumetric flow rate at the entrance of the downhole fluid supply system. For example, the volumetric flow rate may be increase by heating the fluid, inducing a phase change and/or a chemical reaction in the fluid, and/or other techniques. The output volumetric or mass flow rate of the downhole fluid supply system may be controlled, for example in the case of a downhole steam generator, by controlling one or more of the input reactants (e.g., controlling a volumetric flow rate of water, oxidant, and/or fuel), by controlling a reaction process (e.g., a catalytic or other type of reaction), and/or by controlling other parameters (e.g., an electric power generator, a valve, one or more vents, and/or one or more restrictors).

The steam oscillator system 118 receives heat transfer fluid from the steam generator 116 and emits the received heat transfer fluid into the wellbore 102. The example steam oscillator system 118 can receive steam at a particular flow rate which may be substantially constant or may have some controlled variation over time, as described above. The example steam oscillator system 118 can emit the received steam at a time-varying flow rate relative to the input. For example, the steam oscillator system 118 can emit steam into the wellbore 102 at an oscillating flow rate. In some cases, the steam oscillator system includes a steam whistle, steam horn, and/or another fluid oscillator device that propagates sound waves through the wellbore 102, a well completion, and/or the zone 112.

The casing 108 includes perforations 114 through which steam can be injected into the zone of interest 112. In some cases, steam is injected into the zone of interest 112 though the perforations 114 at an oscillating flow rate. Additionally, resources (e.g., oil, gas, and/or others) and other materials (e.g., sand, water, and/or others) may be extracted from the zone of interest through the perforations 114.

The steam oscillator system 118 can include multiple steam oscillator devices at multiple different locations and/or multiple different orientations in the wellbore 102. The steam oscillator system 118 can be installed in a wellbore 102 having a vertical, horizontal, slanted, curved, or another configuration.

Figure 1B:
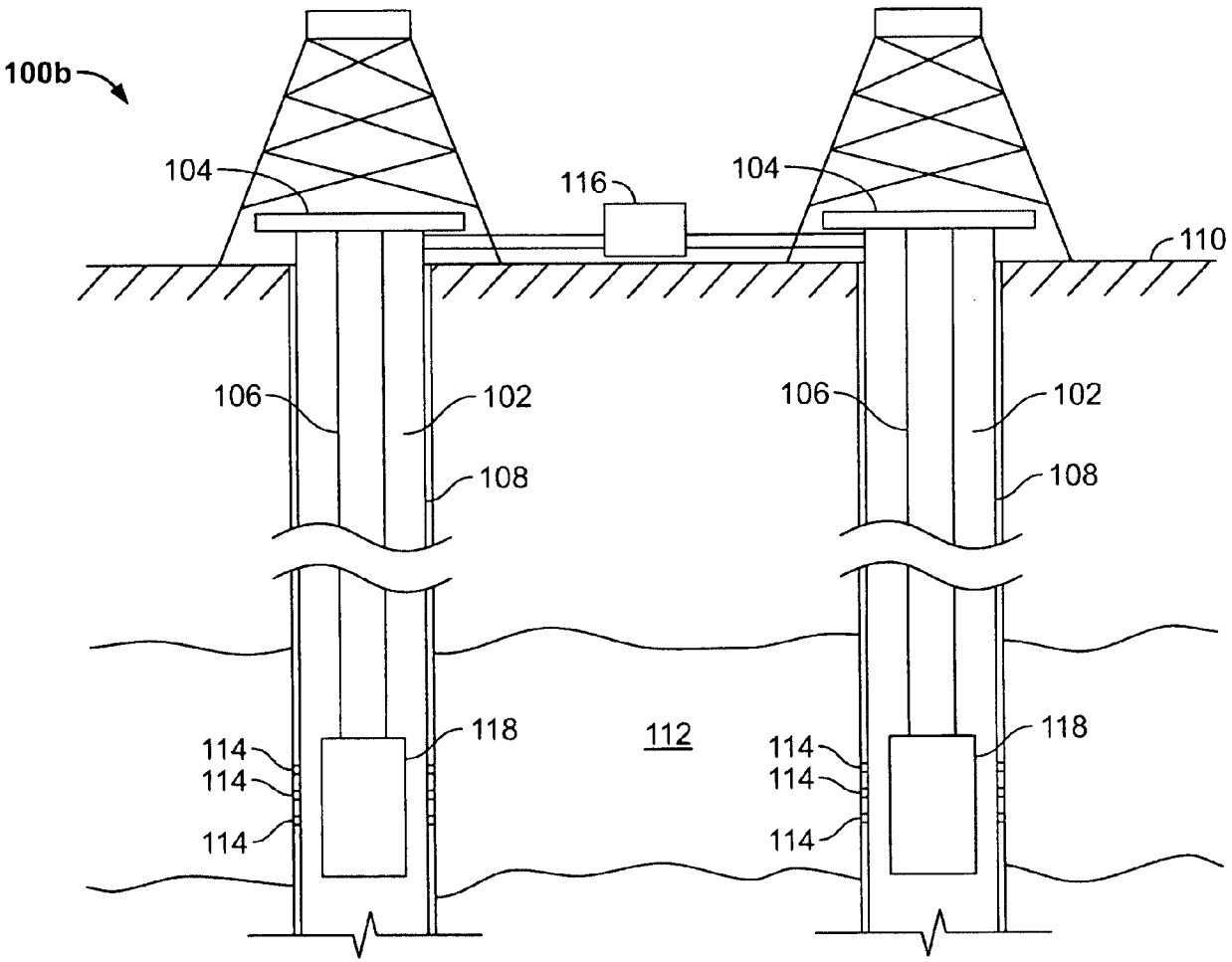

FIG. 1B illustrates an alternate embodiment of an example well system 100*b*. The example well system 100*b* includes a steam generator 116 that resides outside of the wellbore, at the terranean surface. The steam generator 116 of system 100*b* is configured to communicate steam to two different steam oscillator systems 118, which reside in two different wellbores 102. In other implementations, a steam oscillator system 118 is installed in all or fewer than all of three or more wellbores 102 of a single well system.

In some cases, the steam generator 116 only communicates steam to one of the two wellbores 102. For example, the steam oscillator system 118 of a first wellbore 102 may inject steam into the zone 112, while resources are produced from a second wellbore 102. The steam injected into the zone 112 from the first wellbore 102 may stimulate productivity at the second wellbore 102. For example, the thermal properties of the steam may heat the resources in the zone 112, thereby reducing the viscosity of the resources. In other cases, both steam oscillator systems 118 are used to simultaneously inject steam into the zone 112.

Figure 2:
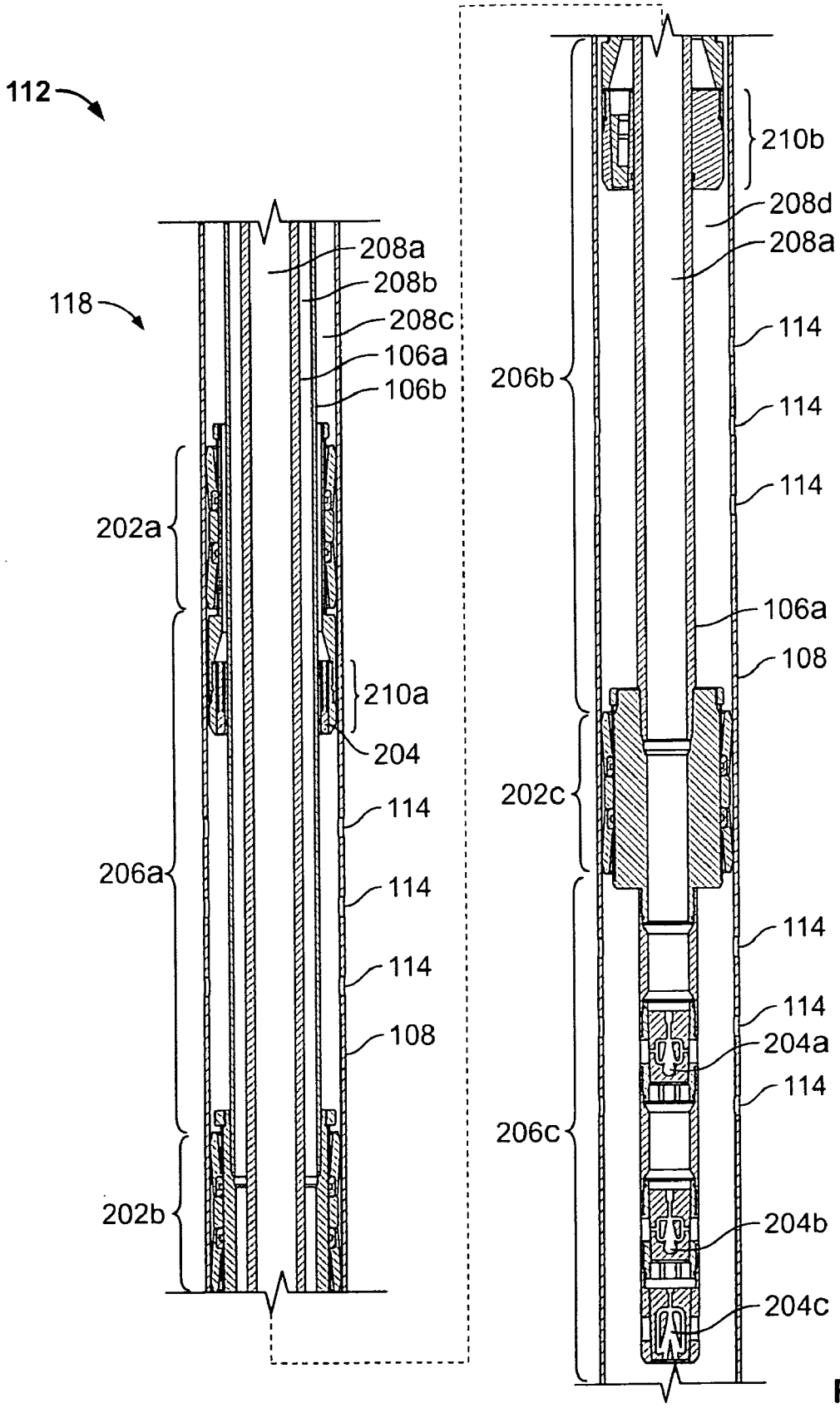
FIG. 2 is a schematic, side cross-sectional view of an example steam oscillator system.

FIG. 2 is a diagram illustrating an example steam oscillator system 118. The example steam oscillator system 118 is configured for installation in a wellbore 102. The wellbore 102 includes the casing 108 and the perforations 114. The illustrated steam oscillator system 118 includes an inner working string 106*a*, an outer working string 106*b*, packers 202*a*, 202*b*, 202*c*, and multiple steam oscillator devices 204 installed in housings 210. The packers 202 are illustrated as cup-type packers, but could be another type of packer, and operate to isolate axial regions 206 of the wellbore 102. For example, a packer 202 may seal or substantially seal to the casing 108 to isolate an axial section of the wellbore 102. In the illustrated example, an upper region 206*a* of the wellbore 102 is isolated between a first packer 202*a* and a second packer 202*b*. An intermediate region 206*b* of the wellbore 102 is isolated between the second packer 202*b* and a third packer 202*c*. The third packer 202*c* isolates a lower region 206*c* of the wellbore.

The working strings 106 define annular sections in the wellbore 102. In the illustrated system 118, the inner working string 106*a* defines an inner flow path 208*a*, for example, through the regions 206*a*, 206*b*, and 206*c*. The inner flow path 208*a* extends radially from the radial center of the wellbore to the inner diameter of the outer working string 106*b*. The inner working string 106*a* and the outer working string 106*b* define a middle annulus 208*b* above and within the upper region 206*a*. The middle annulus 208*b* extends radially from the outer diameter of the inner working string 106*a* to the inner diameter of the outer working string 106*b*. The outer working string 106*b* and the casino 108 define an outer annulus 208*c* above and within the upper region 206*a*. The outer annulus 208*c* extends radially from the outer diameter of the outer working string 106*b* to the inner diameter of the casing 108. Below the packer 202*b*, for example in the intermediate region 206*b* and the lower region 206*c*, an annulus 208*d* is defined between the outer diameter of the outer working string 106*b* and the inner diameter of the casing 108.

In the illustrated example, steam oscillator devices 204 are configured to oscillate steam into each of the three regions 206*a*, 206*b*, and 206*c*. A steam oscillator device 204 typically includes one or more inlets for receiving heat transfer fluid, for example, from a steam generator 116. A steam oscillator device 204 typically includes one or more outlets for directing the received heat transfer fluid into an annulus 208 within the wellbore 102, into the zone 112, and/or into another region. During operation, the steam oscillator device 204 communicates heat transfer fluid from the one or more inlets, through all or part of its interior volume, to the one or more outlets. The interior surfaces of the steam oscillator device 204 that cause the flow of heat transfer fluid to oscillate can remain static during operation in varying a flow rate of the heat transfer fluid through the outlet. In certain instances, the steam oscillator device 204 can have no moving parts. In some cases, a steam oscillator device 204 includes a whistle or another device to generate sound waves based on a flow of compressible fluid through the steam oscillator device 204. Some examples of steam oscillator devices 204 that include whistles are illustrated in FIGS. 4A-4L.

A steam oscillator device 204 may be implemented as an annular steam oscillator device 204, installed in an annulus of the wellbore 102. For example, the steam oscillator device 204 illustrated in FIGS. 3M-Q is a tapered insert designed for installation in an annular housing 210. During operation, the steam oscillator device 204 can experience translational, rotational, vibrational, and/or another type of movement, while maintaining a static internal configuration. The static internal configuration of the steam oscillator device 204 can oscillate a flow of heat transfer fluid through an outlet of the steam oscillator device 204. In some implementations, oscillation of compressible fluid through the outlet can generate longitudinal compression waves (e.g., sound waves). The compression waves can be transmitted to and propagate through a surrounding subterranean zone. In some cases, the compression waves can stimulate production of resources and/or other materials (e.g., sand, water, and/or others) from the zone 112. In some cases, the compression waves can stimulate the wellbore tubulars and/or completion elements to help produce the resources to the surface 110, and/or to prevent or help remediate an undesirable condition. Examples of conditions that may be remediated include build-up or deposit of scale, asphaltines, waxes, sand, hydrates, or another material that can impede production.

In the upper region 206*a*, a housing 210*a* is installed below the packer 202*a*. The housing 210*a* carries multiple steam oscillator devices 204 to inject steam into the outer annulus 208*c* of the upper region 206*a* at a time-varying flow rate. For example, during operation, heat transfer fluid may be communicated from the steam generator 116 to the housing 210 through the outer annulus 208*c* above the packer 202*a*. A sub 306, illustrated in FIGS. 3E-3H, defines a flow path allowing communication of heat transfer fluid from the outer annulus 208*c* past the packer 202*a* into the inlets of the steam oscillator devices 204 installed in the housing 210*a*. The steam may be injected into the zone 112 at an oscillating flow rate from the upper region 206*a* through the perforations 114.

In the intermediate region 206*b*, a housing 210*b* is installed below the packer 202*b*. The housing 210*b* carries steam oscillator devices 204 to inject steam into the annulus 208*d* of the intermediate region 206*b* at a time-varying flow rate. For example, during operation, heat transfer fluid may be communicated from the steam generator 116 to the housing 210*b* through the middle annulus 208*b* above the packer 202*b*. A sub 306, illustrated in FIGS. 3A-3D, defines a flow path allowing communication of heat transfer fluid from the upper region 206*a* past the packer 202*b* into the inlets of the steam oscillator devices 204 installed in the housing 210*b*. The steam may be injected into the zone 112 at an oscillating flow rate from the intermediate region 206*b* through the perforations 114.

Three steam oscillator devices 204*a*, 204*b*, and 204*c* inject steam into the annulus 208*d* of the lower region 206*c* at a time-varying flow rate. For example, during operation, heat transfer fluid may be communicated from the steam generator 116 to the steam oscillator devices 204*a*, 204*b*, and 204*c* through the inner flow path 208*a*. A sub 306, illustrated in FIGS. 3I-L defines a flow path allowing communication of heat transfer fluid below the packer 202*c* into the inlets of the steam oscillator devices 204*a*, 204*b*, 204*c* installed in the sub 306. The steam may be injected into the zone 112 at an oscillating flow rate from the lower region 206*c* through the perforations 114.

The steam oscillator system 118 is an example implementation, and other implementations may include the same, fewer, and/or additional features. In some implementations, a different number of annular sections are defined within the wellbore 102. For example, an intermediate working string may be used to define one or more additional annular sections. In some cases, a different number of packers 202 are used to isolate the same or a different number of axial regions 206 in the wellbore 102. In some implementations, more than one housing 210 is installed in one or more of the axial regions 206. All of the example steam oscillator devices 204 are implemented without moving parts, which may allow the steam oscillator devices 204 to perform more consistently and/or to be more durable over long-term operation. However, in other implementations, one or more of the steam oscillator devices 204 includes moving parts.

Figure 3A:
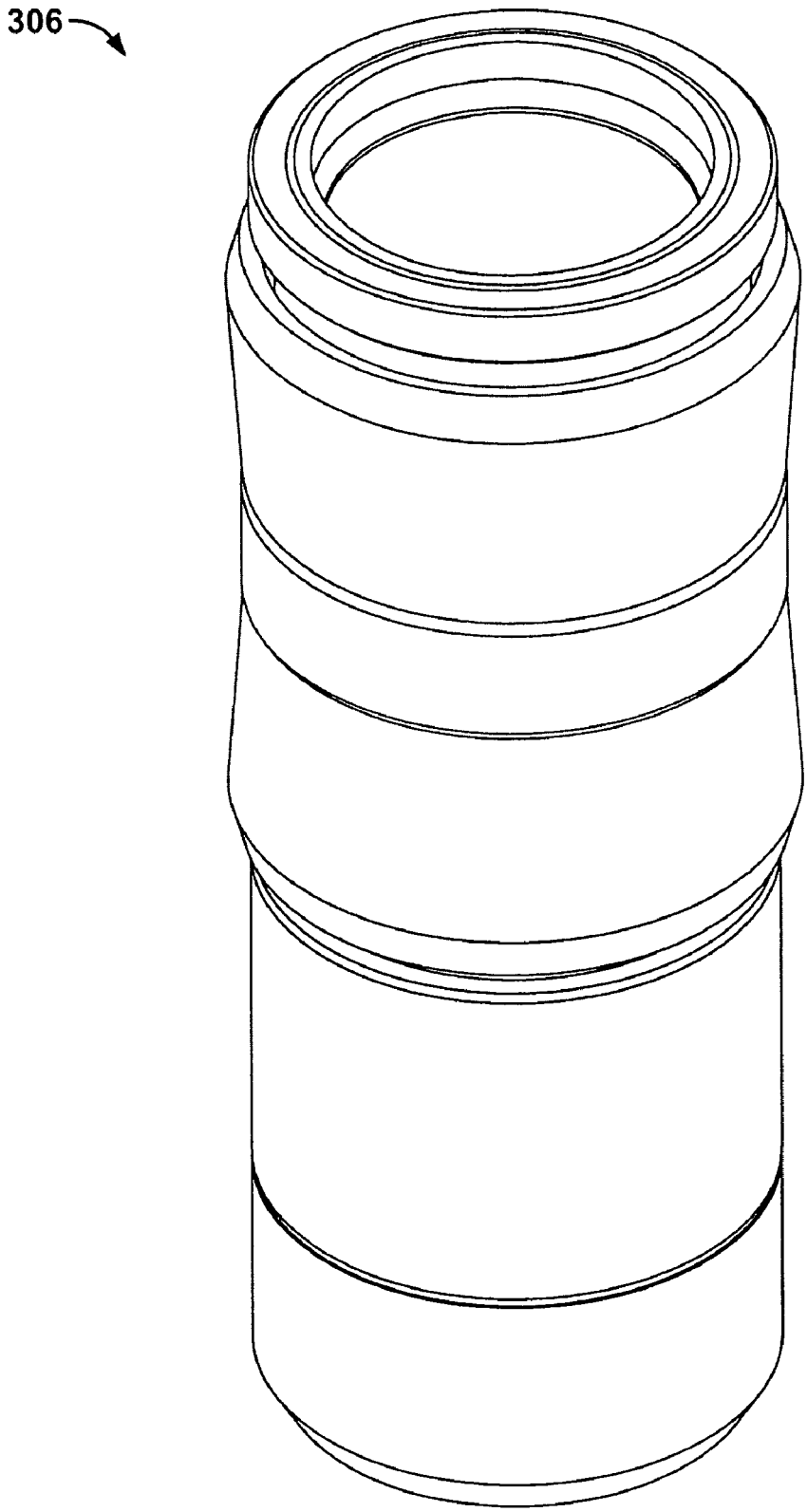
Figure 3B:
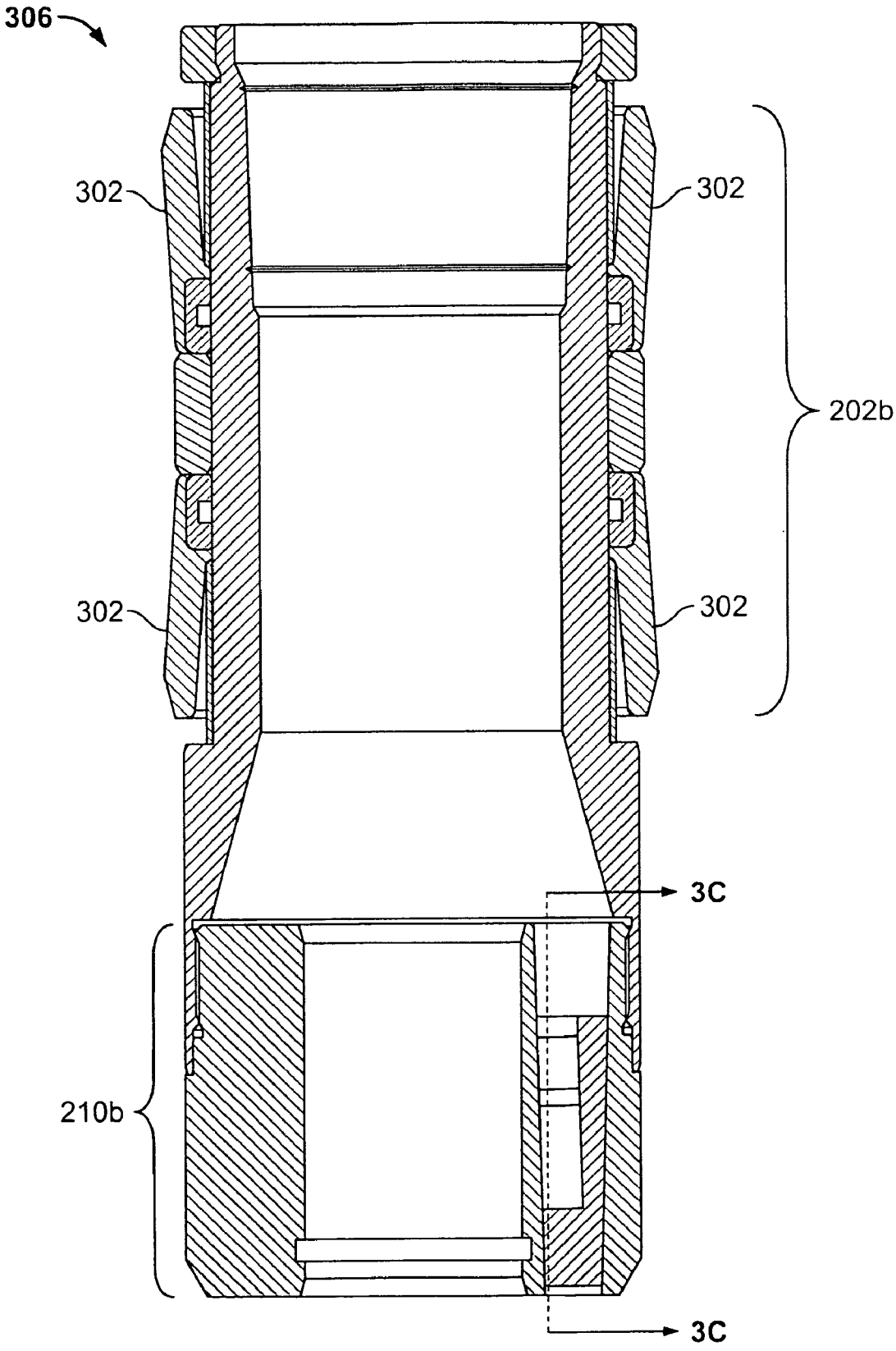
Figure 3C:
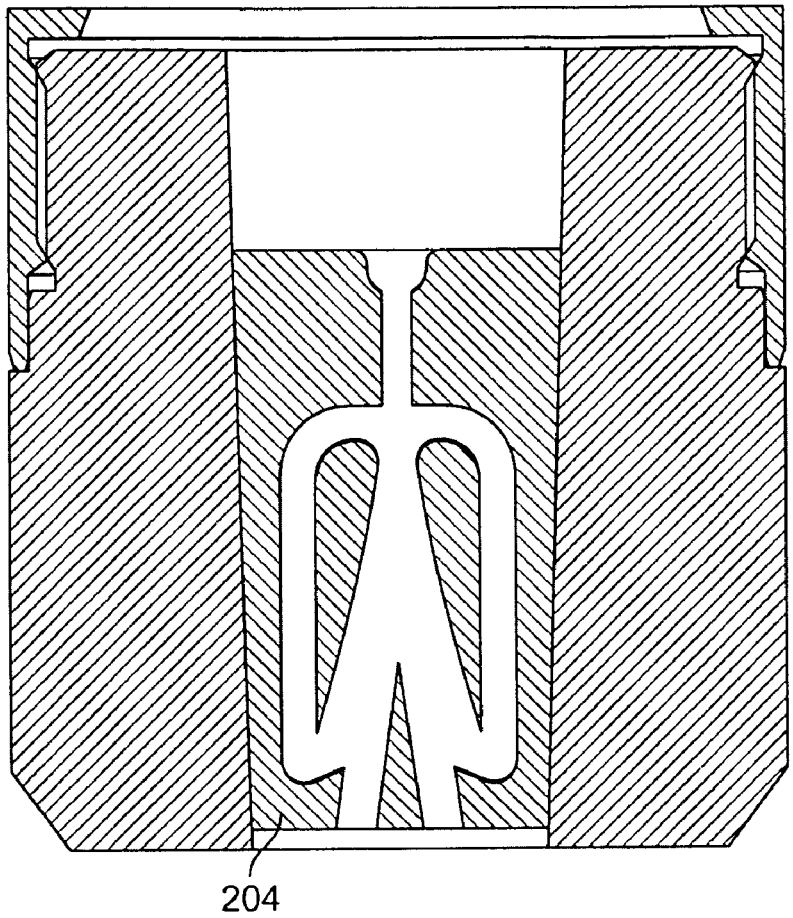
Figure 3D:
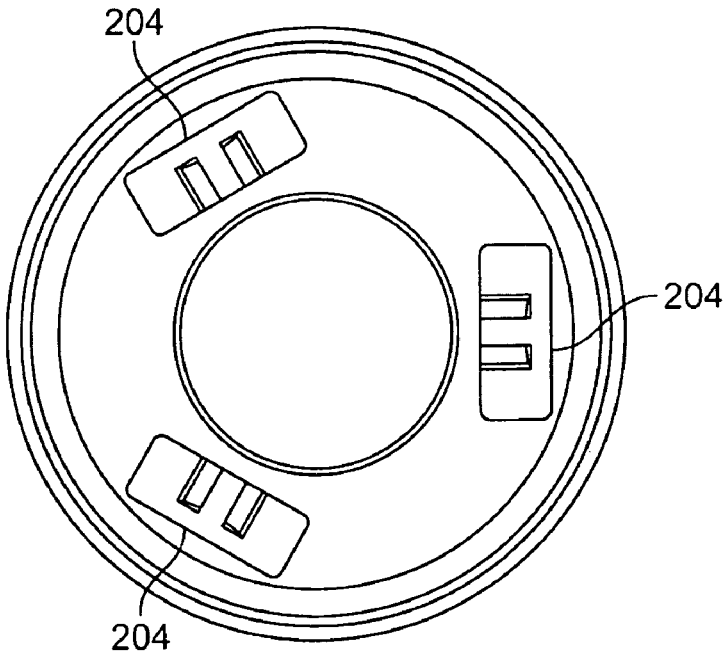

FIGS. 3A-D are diagrams illustrating an example sub 306 having the packer 202*b* and housing 210*b* of FIG. 2. FIG. 3A is a perspective view of the exterior of the sub 306. The sub 306 includes multiple axial sections that are fabricated separately and assembled before, during, or after installation in the wellbore 102. FIG. 3B is a cross-sectional view of the sub 306. The sub 306 carries the packer 202*b* around a first axial section of the sub 306. The illustrated packer 202*b* includes cup seals 302; one oriented to seal or substantially seal against flow in a downhole direction and one oriented to seal or substantially seal against flow in an uphole direction. The seals 302 isolate axial regions of the wellbore 102 from one another. The sub 306 also defines an annulus in fluid communication with the housing 210*b*. The housing 210*b* defines three tapered slots distributed circumferentially around the housing 210*b*. A tapered fluid oscillator device 204 is installed in each of the slots. During operation, heat transfer fluid flows through the middle annulus 208*b* into each of the steam oscillator devices 204. The steam oscillator devices 204 operate in a static configuration to oscillate the flow of heat transfer fluid into the intermediate region 206*b* below the housing 210*b*. FIG. 3C illustrates a cross sectional view of the housing 210*b*. FIG. 3D illustrates an end view of the sub 306 from the housing end of the sub 306. The end view illustrates the circumferential distribution of the fluid oscillator devices 204 in the housing 210*b*.

Figure 3E:
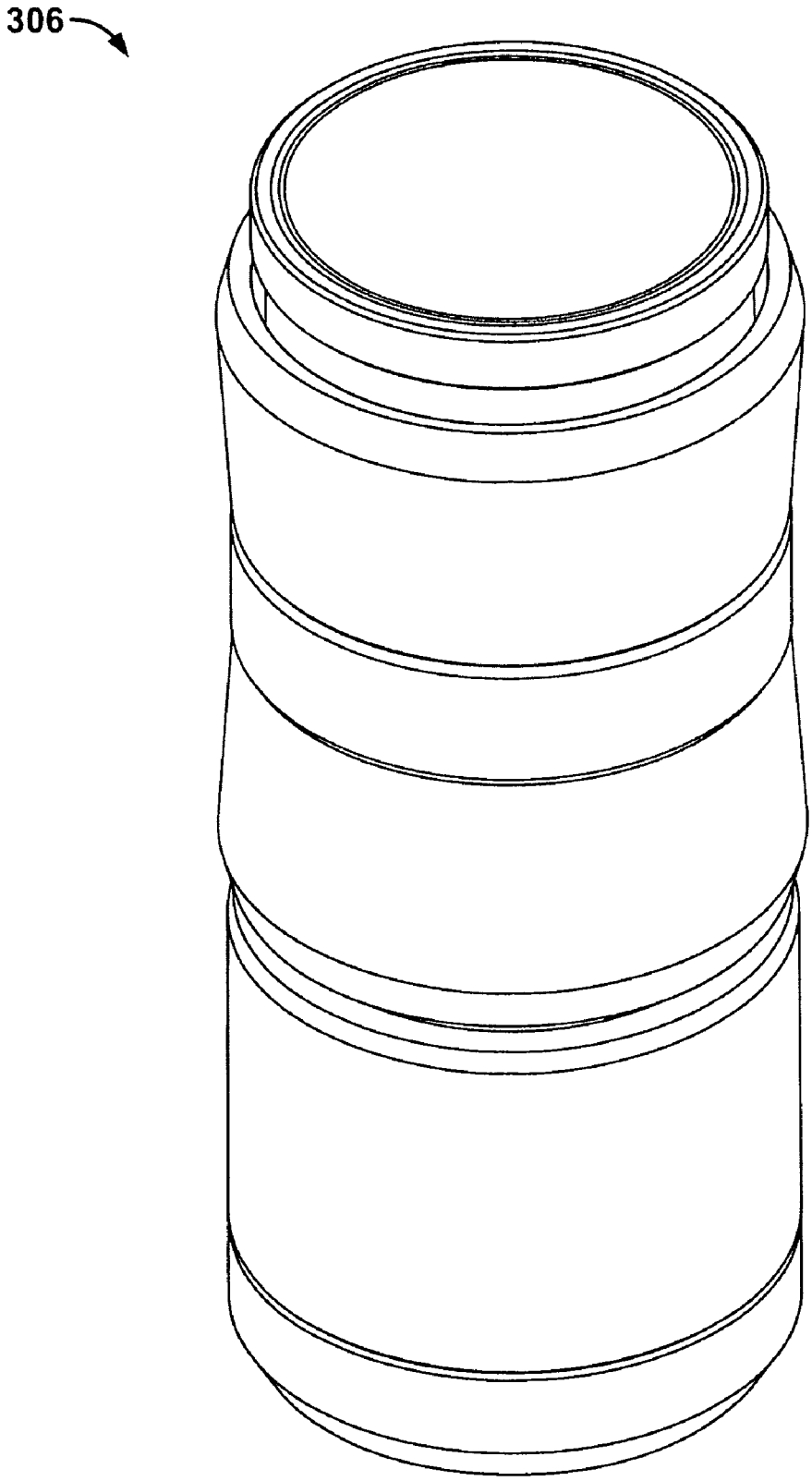
Figure 3F:
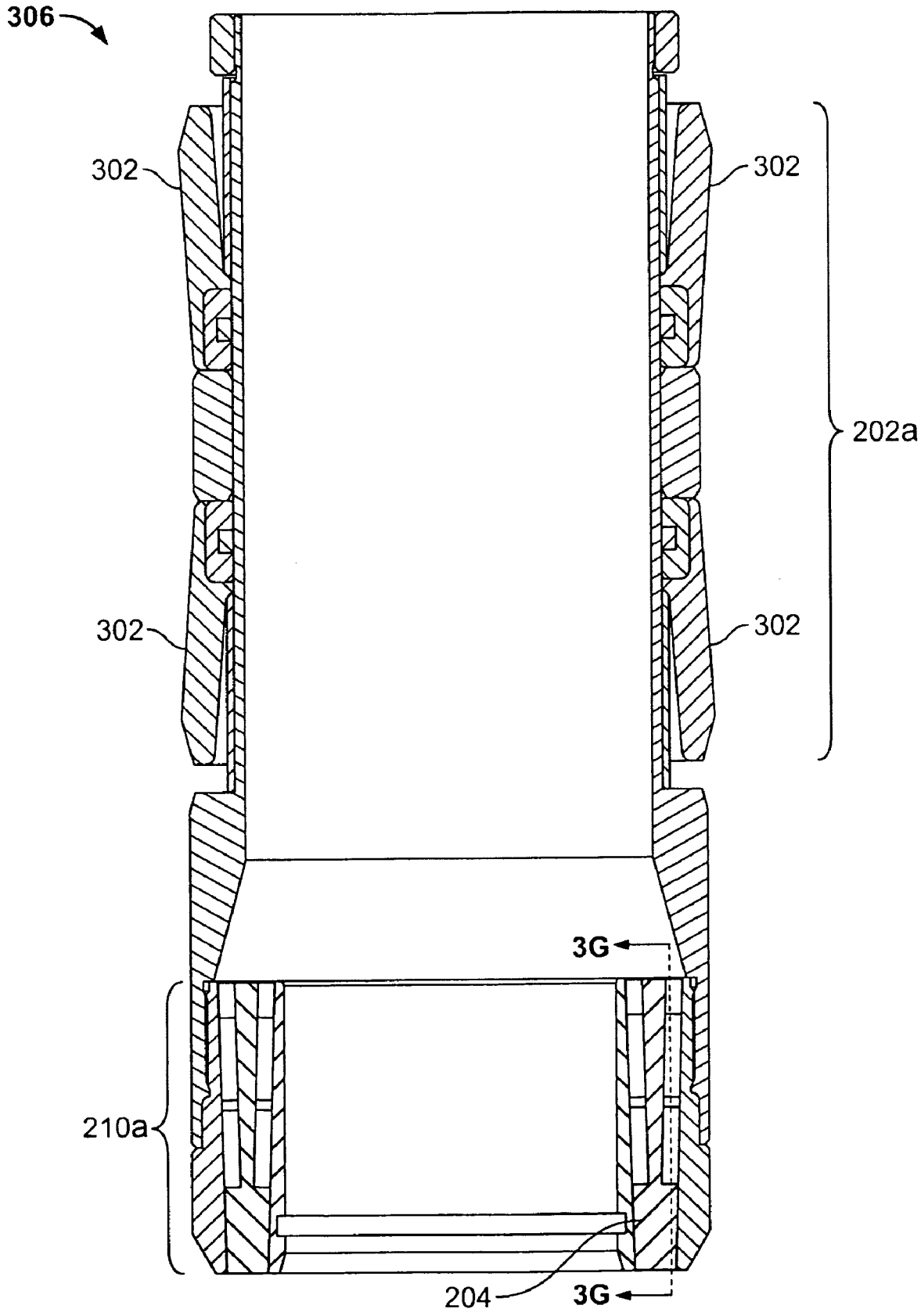
Figure 3G:
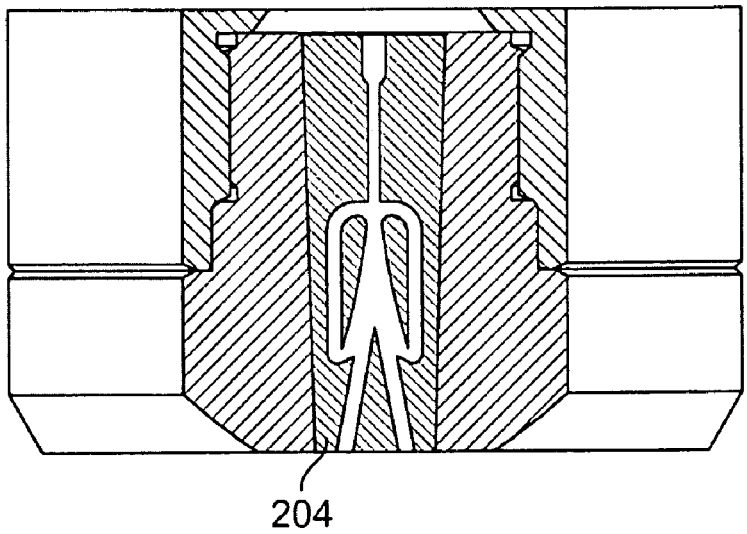
Figure 3H:
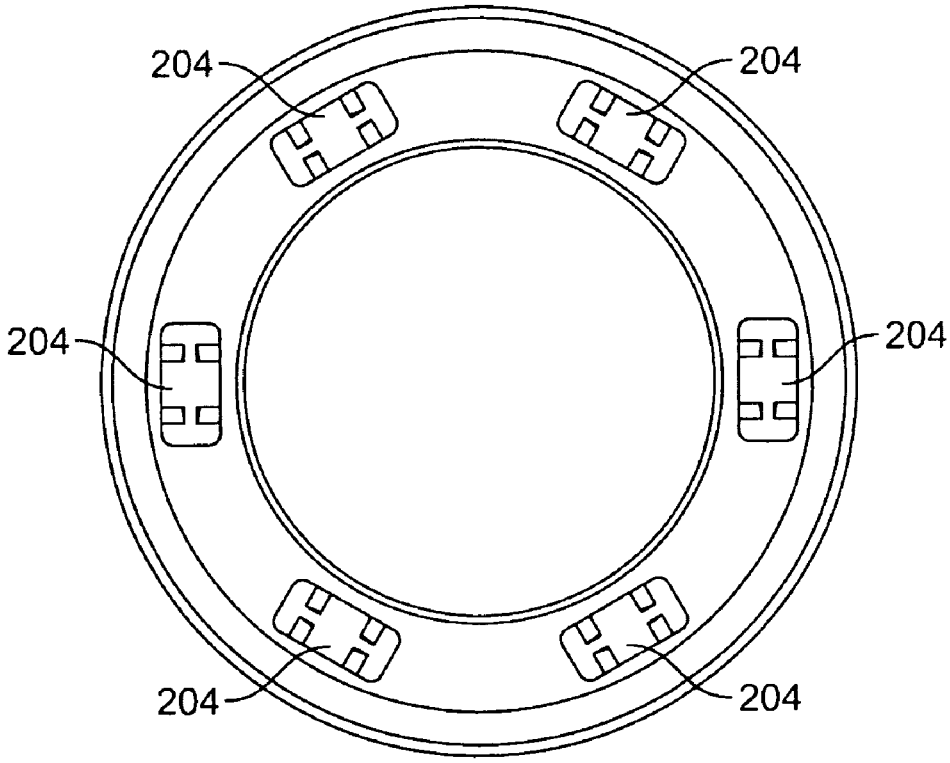

FIGS. 3E-H are diagrams illustrating an example sub 306 having the packer 202*a* and the housing 210*a* of FIG. 2. FIG. 3E is a perspective view of the exterior of the sub 306. The sub 306 includes multiple axial sections that are fabricated separately and assembled before, during, or after installation in the wellbore 102. FIG. 3F is a cross-sectional view of the sub 306. The sub 306 carries the packer 202*a* around a first axial section of the sub 306. The illustrated packer 202*a* includes cup seals 302; one oriented to seal or substantially seal against flow in a downhole direction and one oriented to seal or substantially seal against flow in an uphole direction. The sub 306 also defines an annulus in fluid communication with the housing 210*a*. The housing 210*a* defines six tapered slots distributed circumferentially around the housing 210*a*. A tapered fluid oscillator device 204 is installed in each of the slots. During operation, heat transfer fluid flows through the outer annulus 208*c* into each of the steam oscillator devices 204. The steam oscillator devices 204 operate in a static configuration to oscillate the flow of heat transfer fluid into the upper region 206*a* below the housing 210*a*. FIGS. 3F and 3G illustrates a cross-sectional view of the housing 210*a*. FIG. 3H illustrates an end view of the sub 306 from the housing end of the sub 306. The end view illustrates the circumferential distribution of the fluid oscillator devices 204 within the housing 210*a*.

Figure 3I:
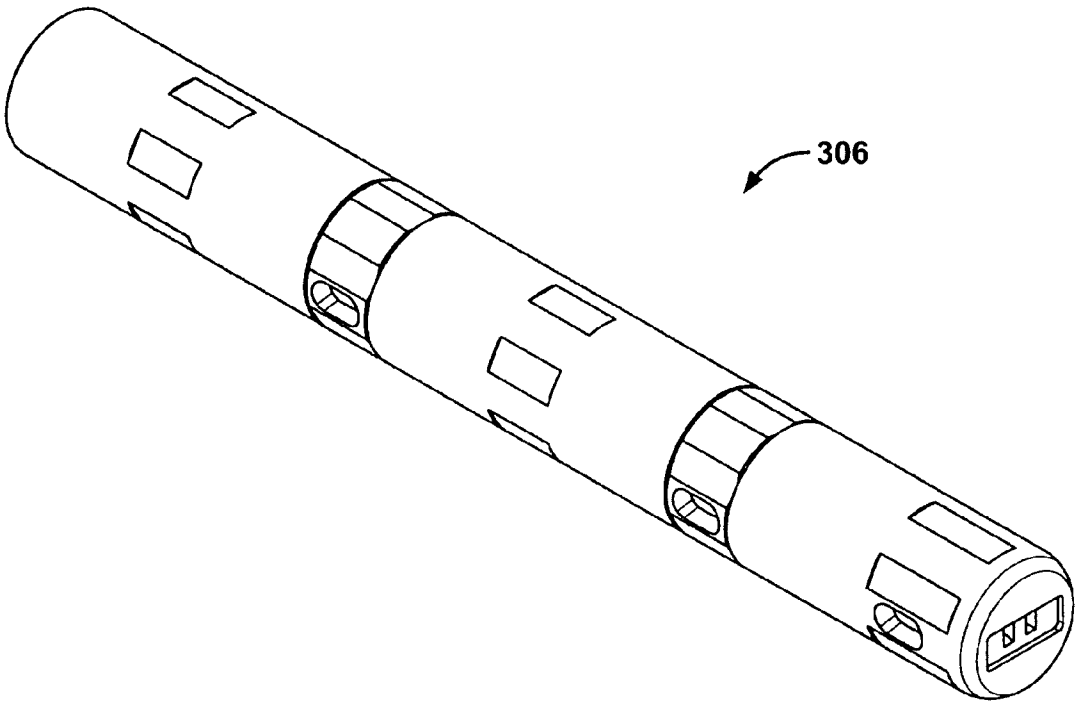
Figure 3J:
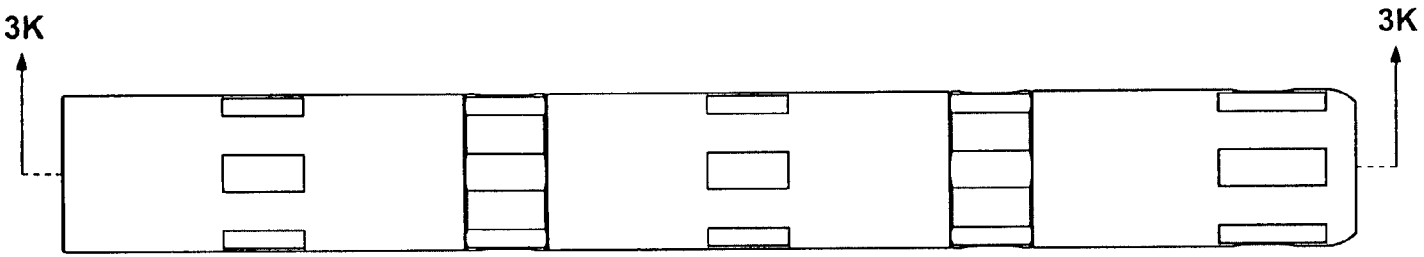
Figure 3K:
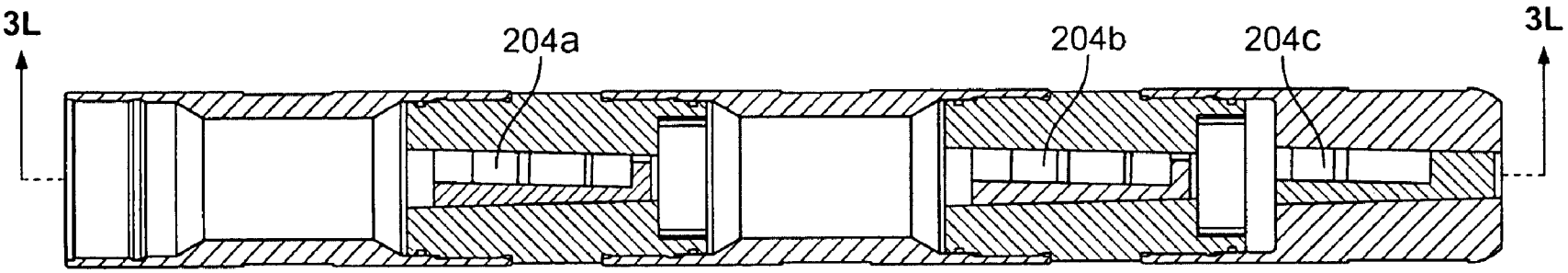
Figure 3L:
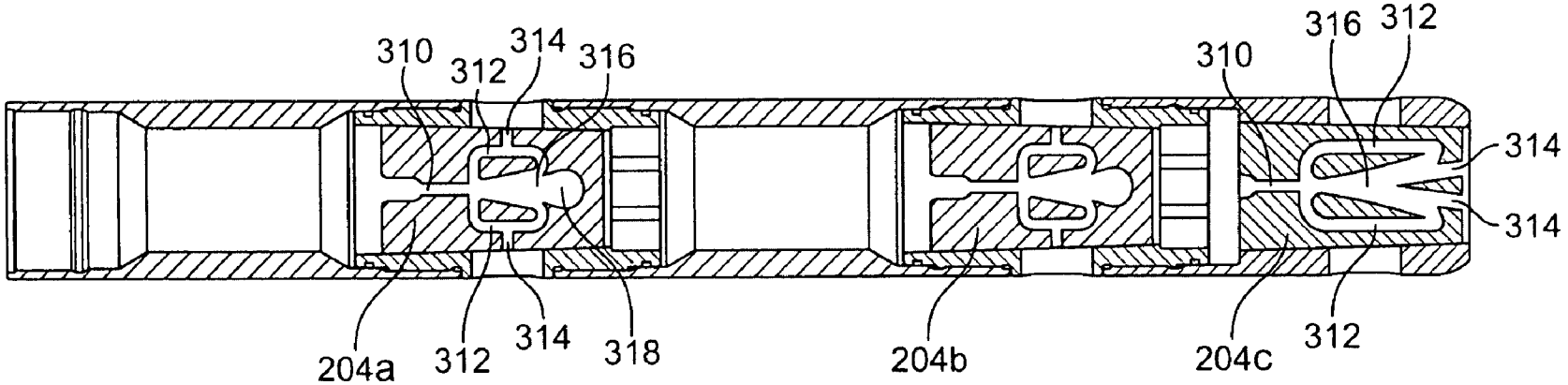
Figure 3M:
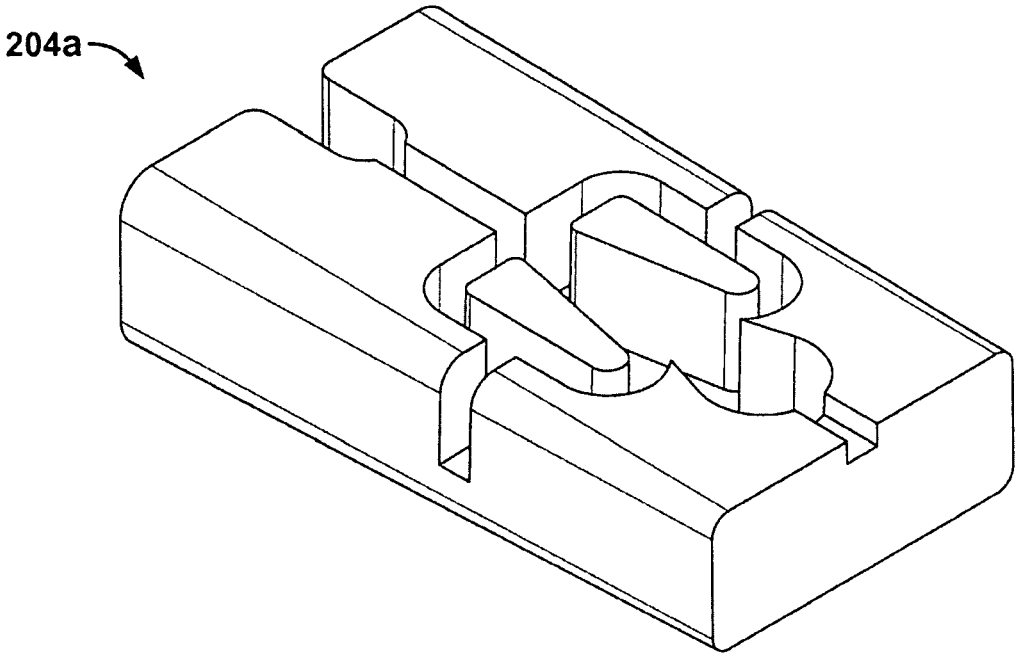
Figure 3N:
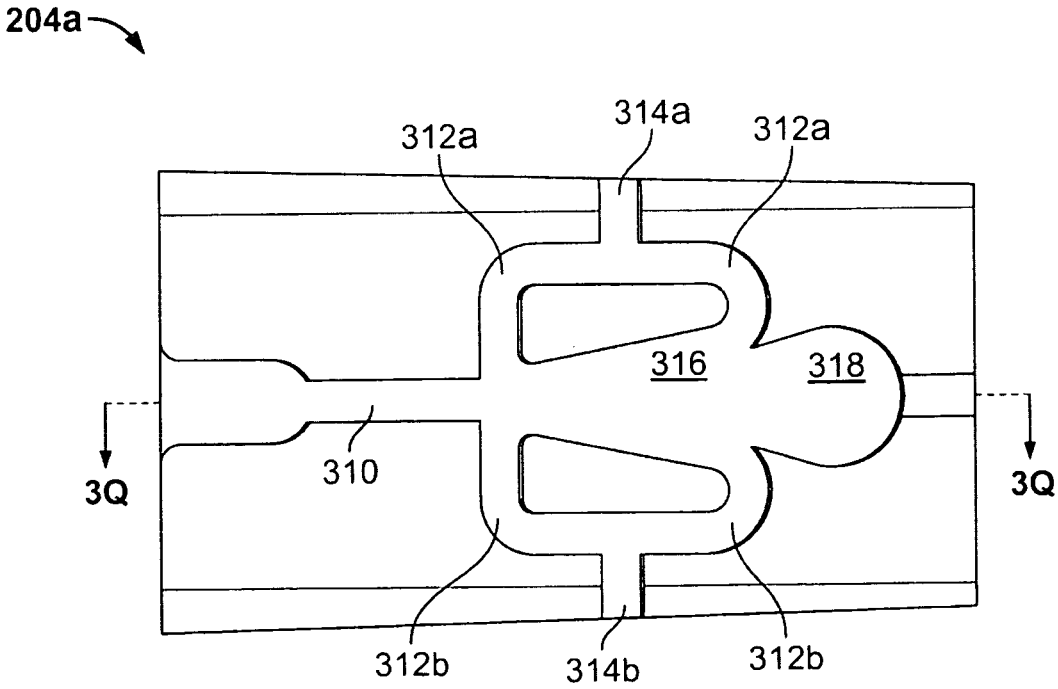
Figure 3O:
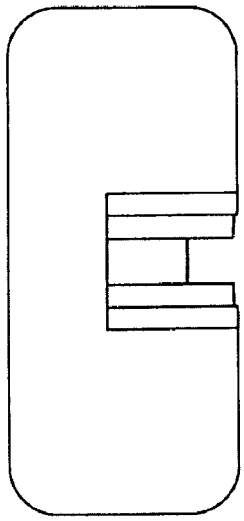
Figure 3P:
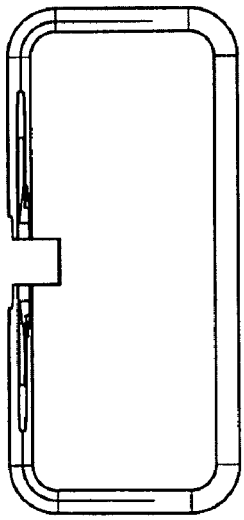
Figure 3Q:
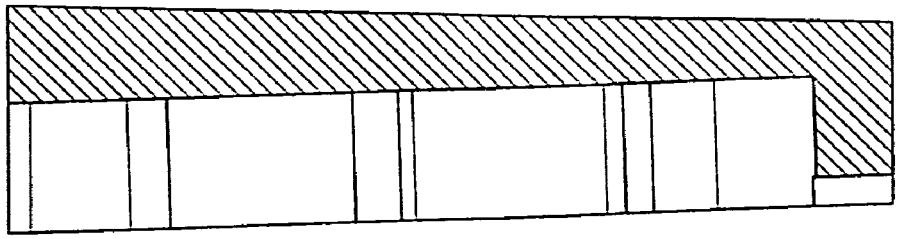

FIGS. 3I-L are diagrams illustrating an example sub 306 having the steam oscillator devices 204*a*, 204*b*, and 204*c* of FIG. 2. FIG. 3I is a perspective view of the exterior of example sub 306. FIG. 3J is a side view of the exterior of the example sub 306. FIG. 3K is a cross-sectional view of the example sub 306, taken along line 3K-3K of FIG. 3J. FIG. 3L is a cross-sectional view of the example sub 306, taken along line 3L-3L of FIG. 3K. Each of the three steam oscillator devices 204*a*, 204*b*, and 204*c* injects heat transfer fluid into the lower region 206*c* of the wellbore 102 at a different axial position. The steam oscillator devices 204*a*, 204*b*, and 204*c* operate in a static configuration to oscillate the flow of heat transfer fluid into the lower region 206*c*. Devices 204*a* and 204*b* define outlets 314 that direct heat transfer fluid in a radial direction. Device 204*c* defines outlets 314 that direct heat transfer fluid in a substantially axial direction.

The volume and flow rate of heat transfer fluid communicated into a particular region 206 of the wellbore 102 may depend on the volume and flow rate of heat transfer fluid communicated into the fluid oscillator devices 204 in addition to the size, number, and configuration of the fluid oscillator devices 204. The fluid oscillator devices 204 installed in the housing 210*a* are smaller than the fluid oscillator devices 204 installed in the housing 210*b*, and thus pose more of a restriction than larger fluid oscillator devices 204. Accordingly, more fluid oscillator devices 204 are installed in the housing 210*a* than are installed in the housing 210*b* to communicate heat transfer fluid into the two regions 206*a* and 206*b* at the same or substantially the same flow rate. In some implementations, the number and size of the fluid oscillator devices 204 in steam oscillator system 118 can be configured to communicate heat transfer fluid into one or more of the regions 206 at different flow rates.

FIGS. 3M-Q are diagrams illustrating the example fluid oscillator device 204*a*. The example steam oscillator device 204*a* includes an interior surface that defines an interior volume of the steam oscillator device 204*a*. The interior surface defines an inlet 310, two feedback flow paths 312*a*, 312*b*, two outlet flow paths 314*a*, 314*b*, a primary chamber 316, and a secondary chamber 318. The primary chamber 316 is defined by a portion of the interior surface that includes two diverging side walls. In the illustration, the diverging sidewalls are angled away from the axis AA and toward each of the feedback flow paths 312*a*, 312*b*. The feedback flow paths 312 extend from the broad end of the primary chamber 316 to the narrow end of the primary chamber 316, near the inlet 310. The outlet flow paths 314*a*, 314*b* extend from the feedback flow paths 312*a*, 312*b*, respectively. The secondary chamber 318 extends from the broad end of the primary chamber 316. The secondary chamber 318 is defined by a portion of the interior surface that includes two diverging sidewalls. In the illustration, the diverging sidewalls diverge away from the axis AA.

The interior surface of the steam oscillator device 204*a* that causes the flow of heat transfer fluid to oscillate is substantially static during operation. As illustrated, the steam oscillator device 204*a* has no moving parts. That is to say that in producing an oscillatory fluid flow, the illustrated example device 204*a* does not rely on linkages or bearing surfaces creating or supporting gross relative movement between mechanical components of the device 204*a*.

In one aspect of operation, heat transfer fluid flows into the steam oscillator device 204*a* through the inlet 310. At a given time, the heat transfer fluid flows along only one of the sidewalls of the primary chamber 316. For example, due to the Coanda effect, the flow of heat transfer fluid may be biased toward one sidewall of the primary chamber 316, creating an imbalanced flow through the chamber 306. As a result, at a given time there may be a faster flow rate into one of the two feedback flow paths 312*a* or 312*b*. The feedback flow paths 312 are configured to direct a portion of the heat transfer fluid back into the primary chamber 316 proximate the inlet 310 so as to perturb the existing flow of heat transfer fluid through the primary chamber 316. For example, the perturbation can cause the flow bias to shift from one sidewall to the other sidewall. In this manner, the flow of heat transfer fluid through the steam oscillator device 204*a* oscillates between the feedback flow paths 312*a* and 312*b*. Accordingly, the flow of heat transfer fluid through each of the outlets 314*a* and 314*b* oscillates over time. For example, the steam oscillator device 204*a* may produce a pulsating flow through each of the outlets 314*a*, 314*b*.

In one aspect of operation, liquid working fluid is directed into the steam oscillator device 204*a*, and the liquid working fluid is vaporized to form a compressible working fluid in the steam oscillator device 204*a*. The compressible working fluid can then flow out of the fluid oscillator device 204*a* at a time-varying flow rate. For example, high pressure liquid water (e.g. water comprising a pressure higher than the pressure of fluids in the surrounding subterranean formation) is communicated into the steam oscillator device 204*a*. The pressure of the liquid water drops when the liquid water enters the steam oscillator device 204*a*. The temperature of the liquid water is sufficient to overcome the heat of vaporization of water, and a phase change is induced, causing the liquid water to vaporize to steam in the steam oscillator device. Depending on thermodynamic conditions, in some implementations, the liquid working fluid can vaporize in any portion of the interior volume of the steam oscillator device 204*a* (e.g., the inlet 310, the primary chamber 316, the feedback flow paths 312, and/or the outlets 314), just before entering the steam oscillator device 204*a*, and/or just after exiting the steam oscillator device.

In one aspect of operation, heat transfer fluid enters the primary chamber from the inlet 310 and flows primarily along a first sidewall toward the feedback flow path 312*a*, and a portion of the heat transfer fluid enters the feedback flow path 312*a*. Some of the heat transfer fluid flows from the feedback flow path 312*a* through the outlet 314*a*, while some of the heat transfer fluid flows from the feedback flow path 312*a* back into the primary chamber 316 proximate the inlet 310. The heat transfer fluid enters the primary chamber 316 proximate the inlet 310 and perturbs the flow of heat transfer fluid through the primary chamber 316 from the inlet 310. The perturbation causes the heat transfer fluid to flow through the primary chamber 316 along the second sidewall (i.e., toward the feedback flow path 312*b*), rather than the first sidewall. A portion of the heat transfer fluid enters the feedback flow path 312*b*. Some of the heat transfer fluid flows from the feedback flow path 312*b* through the outlet 314*b*, while some of the heat transfer fluid flows from the feedback flow path 312*b* back into the primary chamber 316 proximate the inlet 310. The heat transfer fluid enters the primary chamber 316 proximate the inlet 310, and perturbs the flow of heat transfer fluid through the primary chamber 316 from the inlet 310. The perturbation causes the heat transfer fluid to flow through the primary chamber 316 along the first sidewall (i.e., toward the feedback flow path 312*a*), rather than the second sidewall.

The secondary chamber 318 may enhance the frequency and/or amplitude of fluid oscillations through the outlets 314. In the illustrated example, the portion of the interior surface that defines the secondary chamber 318 includes two diverging sidewalls that meet a curved sidewall. In other implementations, the sidewalls are all straight, to form a trapezoidal secondary chamber 318. The secondary chamber 318 can receive a flow of heat transfer fluid and return a feedback flow of heat transfer fluid into the primary chamber 316 to perturb the flow of fluid in the primary chamber 316.

FIGS. 4A-L are diagrams illustrating example steam oscillator systems 118 and steam oscillator system components. The example steam oscillator systems 118 and components in FIGS. 4A-L each include one or more steam oscillator devices 204 that generate oscillatory compression waves in a compressible fluid medium. For example, a steam whistle 204*d* is an example of a steam oscillator device that generates sound waves based on an oscillatory flow of steam and/or other heat transfer fluids. In some cases, the steam whistle 204*d* generates sound waves having frequencies in the range of 100 to 1000 Hz. In other cases, the steam whistle 204*d* generates sound waves having lower or higher frequencies.

Figure 4A:
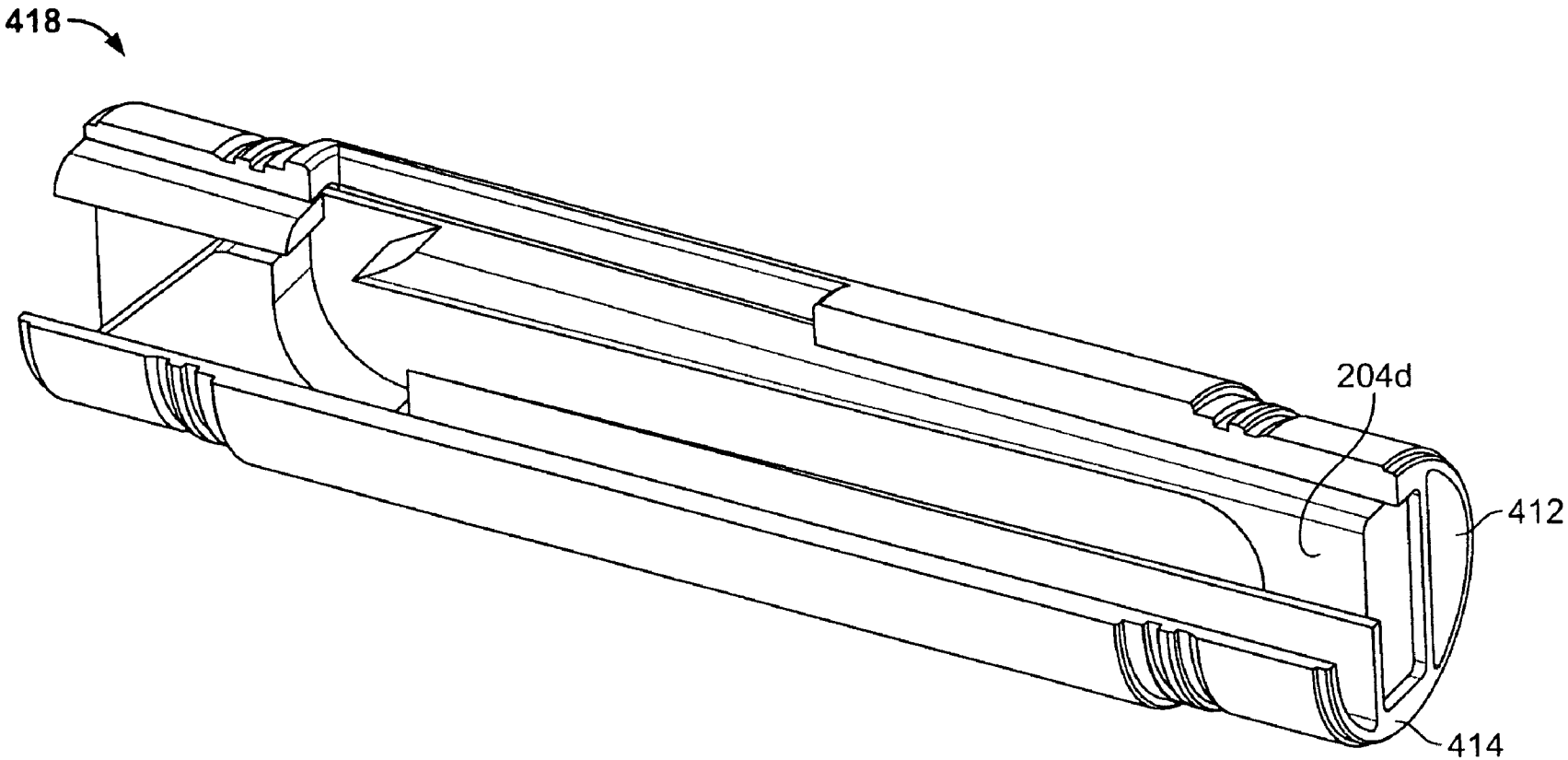
Figure 4B:
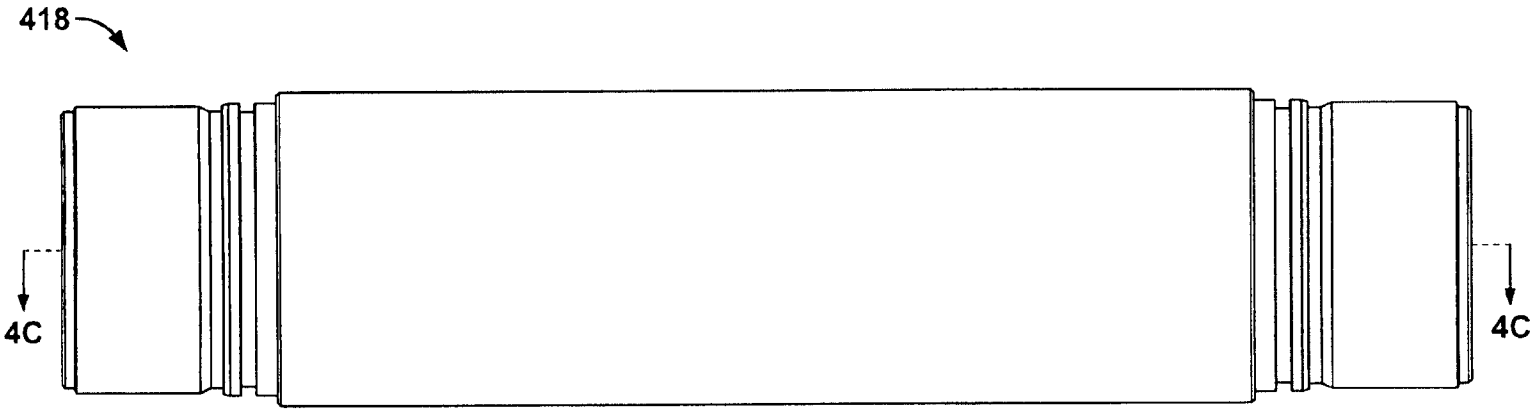
Figure 4C:
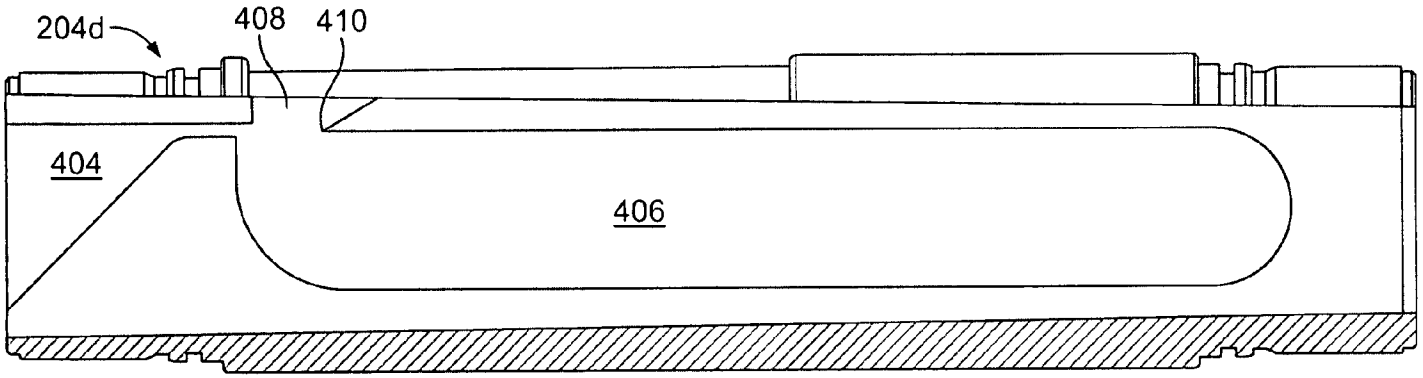
Figure 4D:
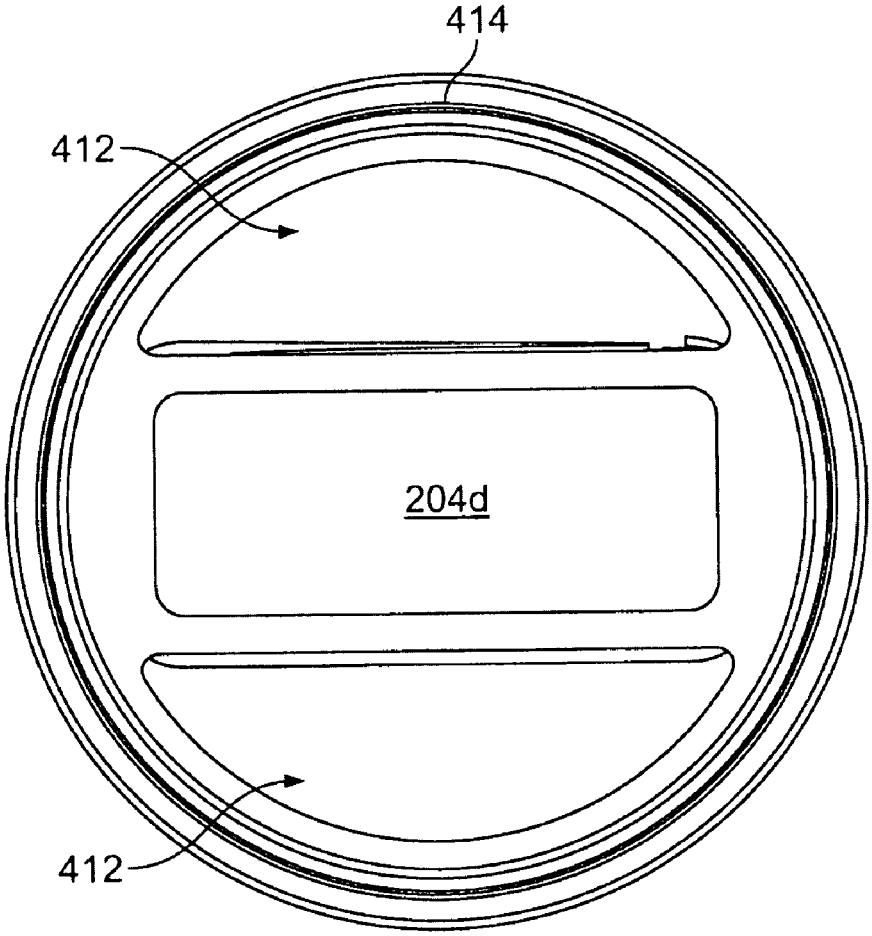

FIGS. 4A-D illustrate an example steam whistle assembly 418 that includes a single steam whistle 204*d*. FIG. 4A is a perspective view showing a partial cross-section of the steam whistle assembly 418. The steam whistle assembly 418 includes a housing 414 that defines two axial steam inflow paths 412 and a cavity for the steam whistle 204*d*. FIG. 4B is a side view of the steam whistle assembly 418. FIG. 4C is a cross-sectional side view of the steam whistle assembly 418 taken along axis 4C-4C of FIG. 4B. FIG. 4D is an end view of the steam whistle assembly 418.

As shown in FIG. 4C, the steam whistle 204*d* includes in inner surface that defines an inlet 404, an outlet 408, and a chamber 406. The steam whistle 204*d* can be implemented with no moving parts. The steam whistle 204*d* has a substantially static configuration to produce an oscillatory flow of heat transfer fluid through the outlet 408. For example, during operation the flow rate of steam through the outlet 408 (e.g., volume of steam per unit time) can oscillate over time. The oscillatory flow of heat transfer fluid may be generated by pressure oscillations in the chamber 406. The pressure oscillations may produce compression waves (e.g., sound waves) in a compressible heat transfer fluid. In some instances, the volume of the chamber 406 can be adjusted, for example, with a adjustable piston in the chamber 406 (not shown), to allow adjustment of the frequency of the oscillations. The compression waves can be transmitted from the wellbore 102 into the zone 112. For example, the compression waves can propagate through and interact with a subterranean formation and the resources therein. Of note, the compression waves need not necessarily propagate solely via the heat transfer fluid and through the perforations in the casing. As will be appreciated, the compression waves will propagate from the whistle through the various solid, compressible and incompressible elements of the wellbore, subterranean formation, and related fluids the casing into the formation.

During operation, steam flows into the steam whistle 204*d* through the inlet 404. The incoming steam strikes the edge 410, and the steam is split with a substantial portion flowing into the chamber 406. As steam flows into the chamber 406, the pressure of the steam in the chamber 406 increases. Due to the pressure increase in the chamber 406, steam inside the chamber 406 begins to flow Out of the steam whistle 204*d* through the outlet 408. The flow of steam from the chamber 406 through the outlet 408 perturbs the flow of steam from the inlet 404, and at least a portion of the steam flowing from the inlet 404 begins to flow directly through the outlet 408 rather than into the chamber 406. As a result, the pressure of the steam in the chamber 406 decreases. Due to the pressure decrease in the chamber 406, the flow of steam from the inlet 404 shifts again and begins to flow into the chamber 406. The cyclic increase and subsequent decrease of the pressure of steam in the chamber 406 continues. In this manner, the pressure of the steam in the chamber 406 oscillates over time, and accordingly, the flow of steam through the outlet 408 oscillates over time.

FIGS. 4E-H are diagrams illustrating an example steam oscillator system 118. The illustrated example steam oscillator system 118 includes a hydrocyclone device that can improve the quality of steam, for example, by separating condensed water out of a mixture of steam and condensed water. In some implementations of a well system 100, the steam that is delivered to the steam oscillation system 118 is not pure steam. For example, the steam may include some condensed water, and the hydrocyclone may reduce or eliminate an amount of condensed water that reaches a steam oscillator device 204. In some cases, condensed water inside of a steam oscillator device 204 can alter the performance of the steam oscillator device 204. For example, liquid water inside the chamber 406 of a steam whistle 204*d* may alter the amplitude and/or frequency of compression waves generated by the steam whistle 204*d*. Therefore, the hydrocyclone device may improve performance of the steam oscillator system 118 by reducing an amount of condensed fluid that reaches a steam oscillator device 204. In certain instances, the hydrocyclone device may be provided apart from a steam oscillator device 204, and used generally to separate particulates and/or condensed liquid from the steam to be injected. In certain instances, a coalescing membrane and/or other type of separator can be used in addition to or as an alternative to the hydrocyclone separator.

Figure 4F:
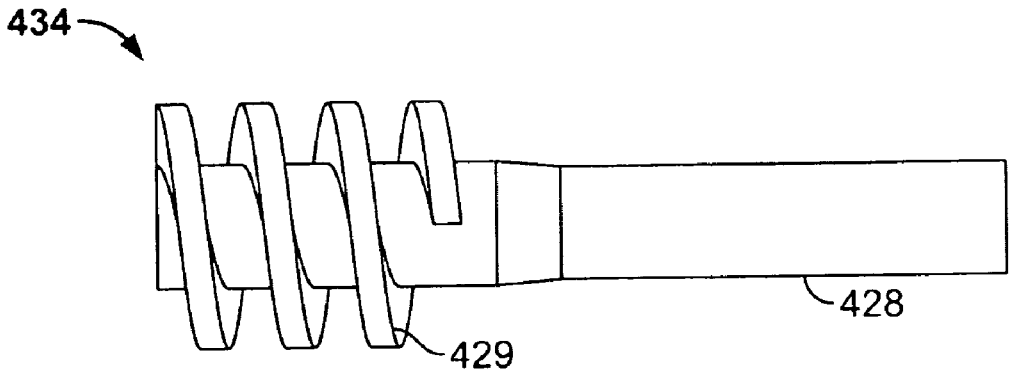
FIG. 4F is a side view of the example insert of FIG. 4E.
Figure 4E:
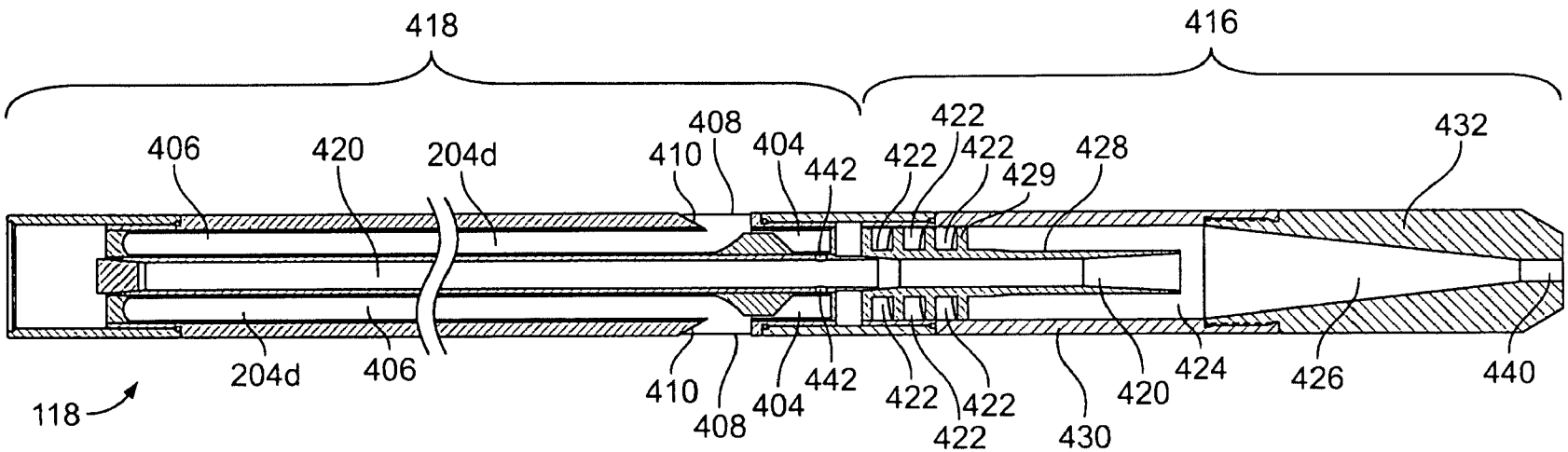
FIG. 4E is a side cross-sectional view of an example steam oscillator system.
Figure 4G:
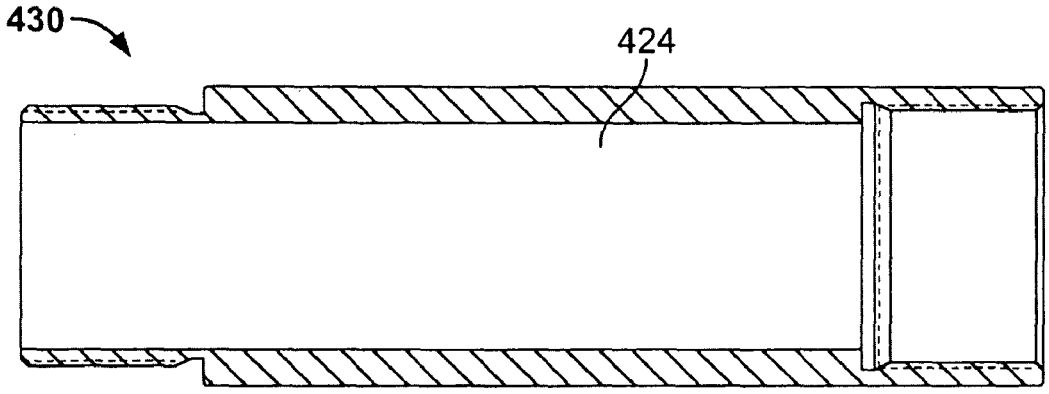
FIG. 4G is a side cross-sectional view of the example sleeve of FIG. 4F.
Figure 4H:
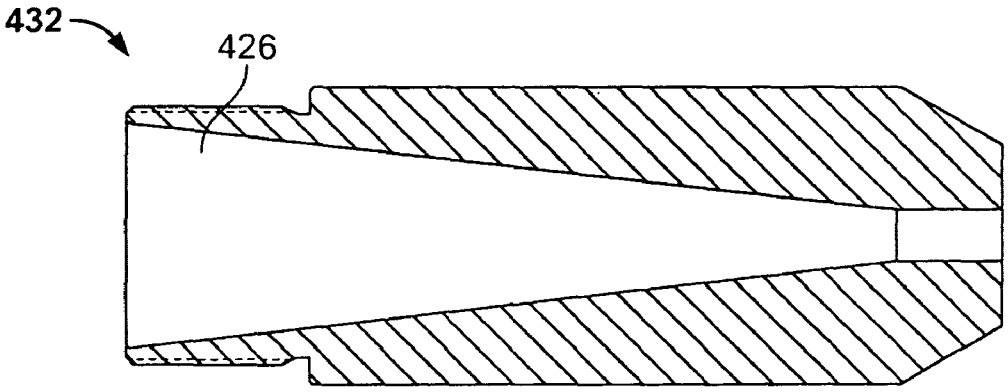
FIG. 4H is a side cross-sectional view of the example hydrocyclone unit of FIG. 4E.

FIG. 4E is a side cross-sectional view of the example steam oscillator system 118. The example steam oscillator system 118 includes a whistle assembly 418 and a hydrocyclone assembly 416. The whistle assembly 418 includes two steam whistles 204*d*. In other implementations, the whistle assembly 418 can include the same or a different number of steam whistles 204*d* in the same or a different configuration. For example, the steam whistle assembly 418 of FIG. 4A and/or FIG. 4I can be implemented in the example steam oscillator system 118 of FIG. 4E. The steam whistle assembly 418 of FIG. 4E is in fluid communication with the hydrocyclone assembly 416. The hydrocyclone assembly 416 includes three components that are illustrated in FIGS. 4F, 4G, and 4H respectively. The three illustrated components of the hydrocyclone assembly 416 include a hydrocyclone unit 432, a sleeve 430, and an insert 434.

In one aspect of operation, steam flows toward the hydrocyclone assembly 416 along an axial flow path (not illustrated) through the whistle assembly 418. For example, the whistle assembly 418 may define one or more steam inflow paths 412, as in the whistle assembly 418 of FIGS. 4A-D. From the axial flow paths in the whistle assembly 418, steam flows into the hydrocyclone assembly 416. The steam that flows into the hydrocyclone assembly 416 may include some condensed water. The hydrocyclone assembly 416 converts the axial flow of steam to a rotary flow of steam in order to separate at least a portion of the condensed water from the steam and to improve the quality of the steam.

When a steam and condensed water mixture enters the hydrocyclone assembly 416, the mixture flows into a circumferential flow path 422 defined by helical threads 429 of the insert 434. As the steam flows along the circumferential flow path 422, the steam acquires angular momentum as it flows into a hydrocyclone inlet annulus 424. From the annulus 424, the steam flows into the hydrocyclone chamber 426. In the hydrocyclone chamber 426, at least a portion of the condensed water and other heavier elements (e.g. particulate) are separated from the pure steam. The condensed water flows in a rotary manner toward the narrow end of the hydrocyclone chamber 426 and through an outlet 440. At least a portion of the steam is separated from the condensed water and flows into the axial flow path 420 defined by a tubular section 428 of the insert 434 and by a tubular surface in the whistle assembly 418. The purified steam flows along the axial flow path 420 into the whistle assembly 418. The surface that defines the axial flow path 420 also defines apertures 442 which allow the steam to flow into the whistle inlets 404. After flowing into the whistles 204*d*, the steam is oscillated through the outlets 408 as described above.

Figure 4I:
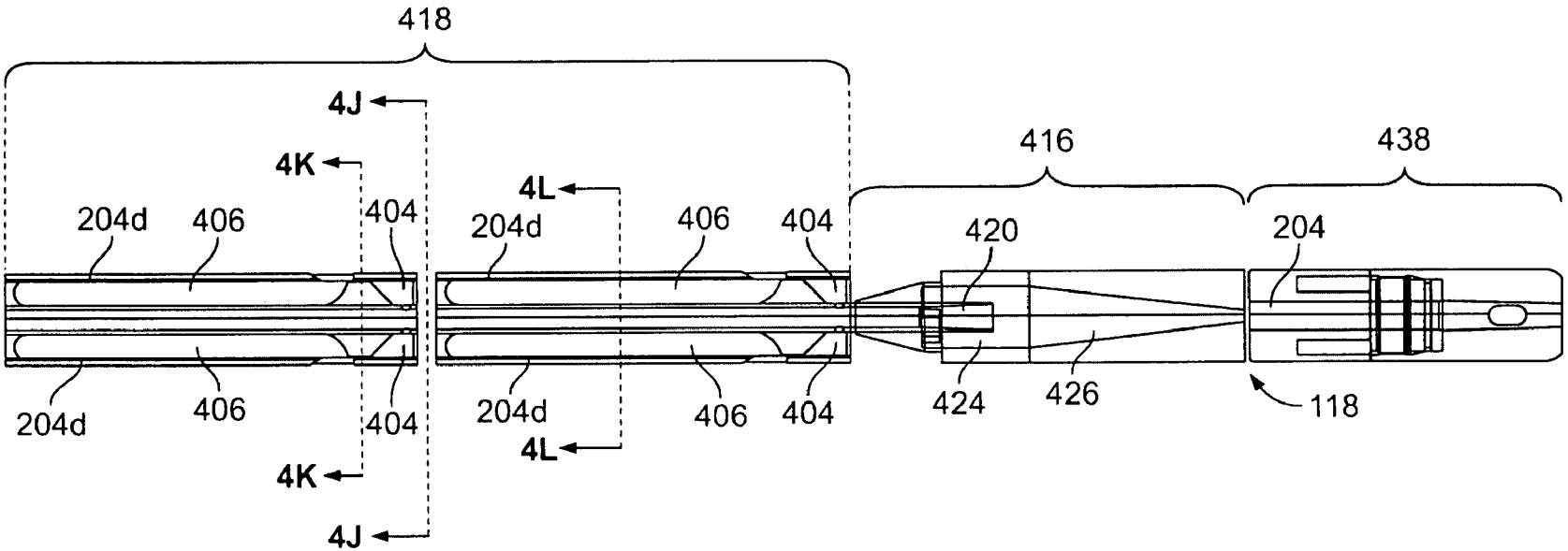
Figure 4J:
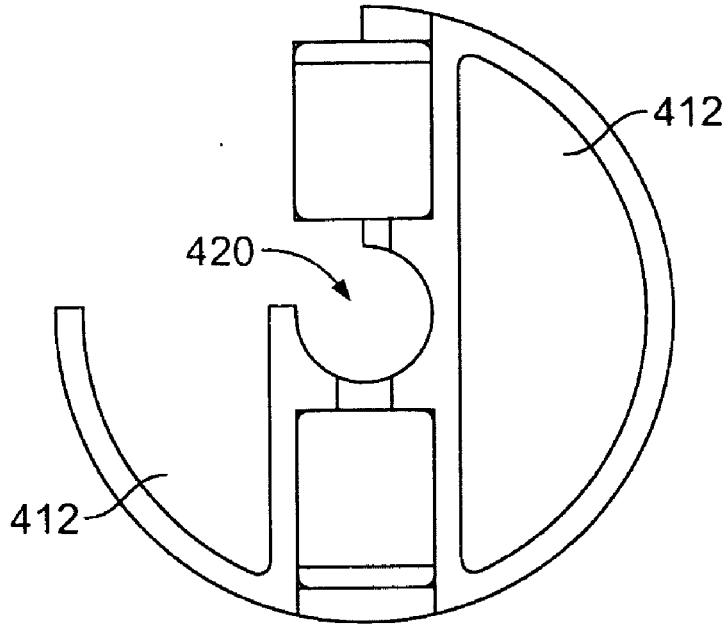
Figure 4K:
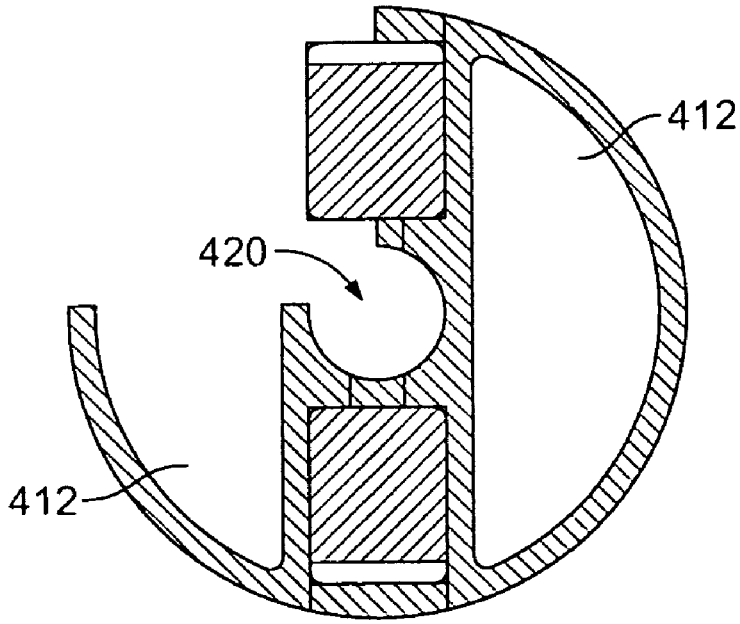
Figure 4L:
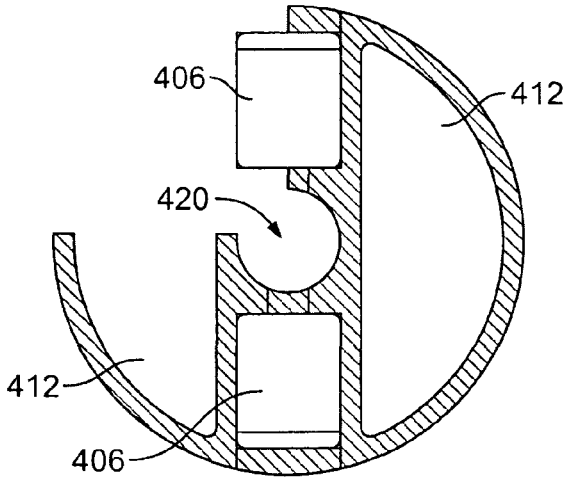

FIGS. 4I-L are diagrams illustrating an example whistle assembly 418. FIG. 4I is a cross-sectional view of the example whistle assembly 418. The illustrated example whistle assembly 118 includes four steam whistles 204*d* in the whistle assembly 418 and a steam oscillator housing 438 to receive a flow of fluid from the outlet 440 of the hydrocyclone assembly 416. For example, the hydrocyclone assembly 416 may separate condensed water from a mixture of condensed water and steam. The separated condensed water may flow through the outlet 440 into an inlet of a steam oscillator device 204 carried in the housing 438. The illustrated example housing 438 defines a tapered slot to carry the tapered steam oscillator device 204. For example, the housing 438 may carry the steam oscillator device 204*a* illustrated in FIG. 3M. FIG. 4J is a cross-sectional view of the steam oscillator system 118 taken along line 4I-4J of FIG. 4I. FIG. 4K is a cross-sectional view of the steam oscillator system taken along line 4K-4K of FIG. 4I. FIG. 4L is a cross-sectional view of the steam oscillator system 118 taken along line 4L-4L of FIG. 4I.

Although a number of different examples of devices for oscillating a compressible flow have been described, it should be appreciated that other types of devices exist. In one example, the oscillator device can include a reed type device where one or more thin strips of stiff material (polymer, metal and/or other material) vibrate to produce oscillations when a compressible flow streams over them similar to the operation of a reeded woodwind instrument. The reeded oscillator device can have a single reed that produces oscillations, two reeds that are independent and/or that cooperate to produce oscillations, or more reeds that are independent and/or that cooperate to produce oscillations.

Figure 5:
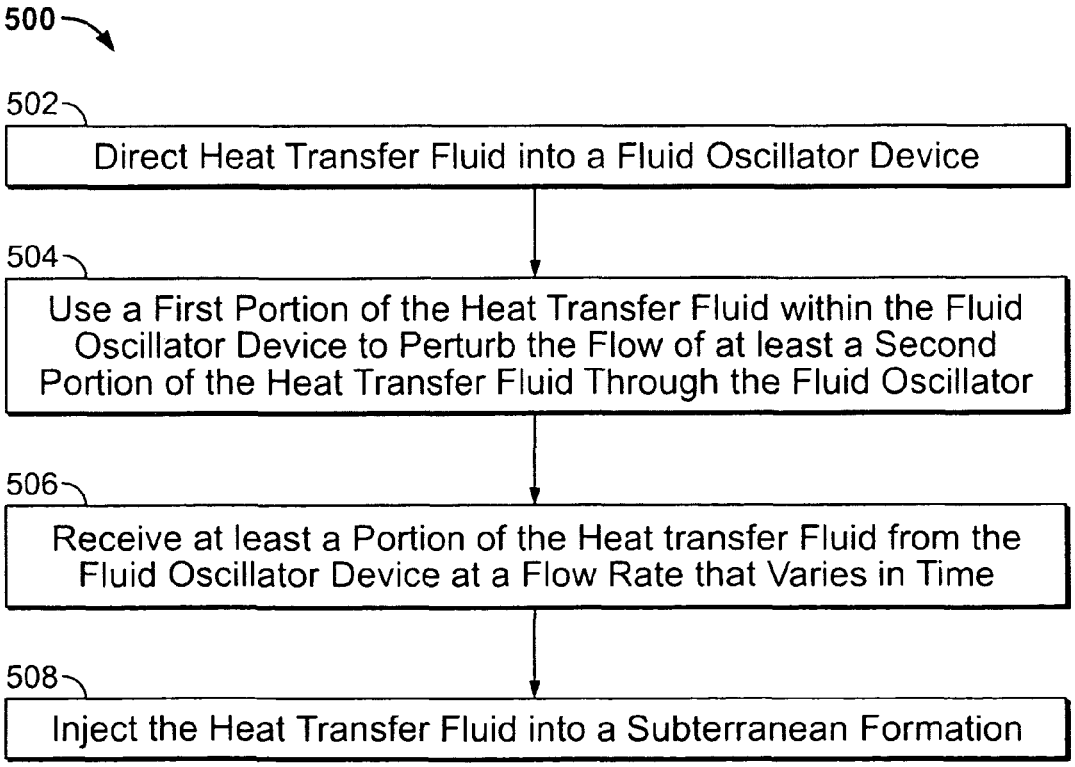
FIG. 5 is a flow chart illustrating an example process for oscillating fluid in a wellbore.

FIG. 5 is a flow chart illustrating an example process for oscillating fluid in a wellbore defined in a subterranean formation. For example, the process 500 may be used to inject heat transfer fluid, such as steam, into a subterranean formation through a wellbore defined in the subterranean formation, in order to stimulate production of resources from the formation. Additionally or alternatively, the process 500 may be used to propagate compression waves (e.g., sound waves) into the subterranean formation. In some cases, the heat transfer fluid is generated by a heat transfer fluid generator, such as a steam generator. The steam generator may be installed within the wellbore, or the steam generator may be installed above a ground surface. The steam generator may be in fluid communication with a tubular conduit to communicate the heat transfer fluid to a fluid oscillator device.

At 502, heat transfer fluid is directed into a fluid oscillator device. The heat transfer fluid may be directed into the fluid oscillator at a flow rate that is substantially constant over time. In some implementations, the flow of heat transfer fluid into the fluid oscillator varies over time. The heat transfer fluid flows through an interior volume of the fluid oscillator device.

At 504, a first portion of the heat transfer fluid within the fluid oscillator device is used to perturb a flow of at least a second portion of the heat transfer fluid through the fluid oscillator device. For example, the first portion of heat transfer fluid may be communicated along a feedback flow path toward an inlet into the fluid oscillator device in order to perturb the flow of fluid from the inlet into the interior volume of the device. As another example, the first portion of heat transfer fluid may be communicated into a primary chamber of the fluid oscillator device from a secondary chamber of the fluid oscillator device. The flow of fluid from the secondary chamber my function as a feedback to perturb the flow of fluid through the primary chamber. As another example, the fluid oscillator device may define a resonant chamber. The fluid oscillator device may be configured to cyclically increase and decrease the pressure of compressible heat transfer fluid within the resonant chamber. The periodic pressure variations in the resonant chamber may generate longitudinal compression waves (e.g., sound waves) that propagate through the subterranean formation.

In some cases the perturbation of flow within the fluid oscillator device is repeated in a periodic manner. The periodic perturbation may cause a flow of heat transfer fluid to alternate between two different regions of the fluid oscillator device. For example, the flow of fluid through the fluid oscillator device may periodically oscillate between two flow directions within the device.

At 506, at least a portion of the heat transfer fluid is received from the fluid oscillator at a flow rate that varies in time. The received portion of heat transfer fluid may flow through a flow outlet extending from an interior volume of the fluid oscillator device.

At 508, the heat transfer fluid is injected into the subterranean formation. The heat transfer fluid may enter the subterranean formation from the wellbore, for example, through perforations in a wellbore casing. The heat transfer fluid may transfer heat energy to resources in the formation and reduce viscosity of the resources. The reduced viscosity of the resources may stimulate production of the resources. For example, a flow of resources into a wellbore may be increased as a result of injecting heat transfer fluid into the formation. In some cases, the heat transfer fluid is not injected into the subterranean formation. For example, a steam whistle fluid oscillator device may be used to propagate compression waves into the subterranean formation, and the heat transfer fluid that flows through the steam whistle may remain in the wellbore and/or flow to the surface.

In some implementations of the process 500, a parameter of the fluid flow into the fluid oscillator device is varied among two or more levels over two or more time intervals. Example parameters of input fluid flow that may be varied include volumetric flow rate, mass flow rate, velocity, and others.

A number of implementations have been described. Nevertheless, it will be understood that various modifications may be made. Accordingly, other implementations are within the scope of the following claims.

What is claimed is:

1. A system for oscillating compressible working fluid in a wellbore defined in a subterranean formation, the system comprising:

a fluid supply that communicates compressible injection fluid into a conduit disposed within the wellbore defined in the subterranean formation, the fluid supply comprising a steam generator; and a fluid oscillator device configured to reside in the wellbore and comprising an interior surface defining an interior volume of the fluid oscillator device, an inlet into the interior volume, and an outlet from the interior volume, the interior surface being static during operation to receive the compressible injection fluid into the interior volume through the inlet and to vary over time a flow rate of the compressible injection fluid into the subterranean formation from the interior volume through the outlet.

2. The system of claim 1, wherein the compressible injection fluid comprises heat transfer fluid.

3. The system of claim 2, wherein the fluid supply comprises a heat transfer fluid generator configured to reside in the wellbore.

4. The system of claim 2, wherein the fluid supply comprises a heat transfer fluid generator configured to reside above a ground surface outside of the wellbore.

5. The system of claim 1, wherein the compressible injection fluid comprises steam of less than one hundred percent quality.

6. The system of claim 1, further comprising a conduit in fluid communication with the outlet and configured to inject the compressible injection fluid into the subterranean formation.

7. The system of claim 1, wherein the outlet comprises a first outlet, the fluid oscillator device further comprises a second outlet, and the interior surface is configured to alternate a flow of compressible injection fluid between the first outlet and the second outlet.

8. The system of claim 1, wherein:

the outlet comprises a first outlet from the interior volume;

the fluid oscillator device further comprises a second outlet from the interior volume;

a first portion of the interior surface defines a chamber, a third outlet from the chamber into a first feedback channel, and a fourth outlet from the chamber into a second feedback channel;

a second portion of the interior surface defines the first feedback channel and the first outlet extending from the first feedback channel;

a third portion of the interior surface defines the second feedback channel and the second outlet extending from the second feedback channel;

the inlet is configured to direct the compressible injection fluid into the chamber; and the first and second feedback channels are each configured to direct at least a portion of the compressible injection fluid toward a region in the chamber proximate the inlet.

9. The system of claim 8, wherein the chamber comprises a first chamber, a fourth portion of the interior surface defines a second chamber extending from the first chamber, and the second chamber is configured to receive at least a portion of the compressible injection fluid from the first chamber and to direct at least a portion of the received compressible injection fluid back into the first chamber.

10. The system of claim 1, the conduit comprising an outer conduit, the system further comprising an inner conduit disposed within the outer conduit, the fluid oscillator device configured to receive compressible injection fluid from an annulus between the outer conduit and the inner conduit.

11. The system of claim 1, wherein the compressible injection fluid comprises at least one of air, steam, nitrogen gas, carbon dioxide gas, carbon monoxide gas, or natural gas.

12. The system of claim 1, wherein the interior surface defines a resonant chamber that is static during operation to vary over time a pressure of the compressible injection fluid in the interior volume.

13. The system of claim 1, wherein the fluid oscillator device comprises a whistle.

14. The system of claim 13, further comprising a hydrocyclone device configured to receive a mixture of compressible injection fluid and condensed fluid from the conduit, separate at least a portion of the condensed fluid from a remainder of the mixture, and communicate the remainder of the mixture into the inlet of the whistle.

15. The system of claim 13, further comprising a tapered insert defining at least a portion of the interior volume of the whistle and a tapered slot to receive the tapered insert.

16. The system of claim 1, further comprising a seal configured to reside in the wellbore to define an isolated region of the wellbore, the fluid oscillator device configured to reside in the isolated region.

17. The system of claim 16, the seal comprising at least one packer.

18. A method comprising:

directing a compressible injection fluid through at least a portion of a wellbore defined in a subterranean formation and into a fluid oscillator device installed in the wellbore;

directing at least a first portion of the compressible injection fluid within the fluid oscillator device to perturb a flow of at least a second portion of the compressible injection fluid within the fluid oscillator device;

directing at least a portion of the compressible injection fluid out of the fluid oscillator device at a flow rate that varies over time for injection into the subterranean formation; and injecting the portion of compressible injection fluid into the subterranean formation, wherein injecting the portion of compressible injection fluid into the subterranean formation comprises reducing a viscosity of resources in the subterranean formation.

19. The method of claim 18, wherein injecting the portion of compressible injection fluid into the subterranean formation comprises stimulating a flow of resources through the subterranean formation.

20. The method of claim 18, wherein the wellbore comprises a first wellbore and injecting the portion of compressible injection fluid into the subterranean formation comprises stimulating a flow of resources through the formation into a second wellbore defined in the subterranean formation.

21. The method of claim 18, further comprising periodically compressing a portion of the compressible injection fluid within the fluid oscillator device.

22. The method of claim 21, further comprising propagating sound waves through the subterranean formation, wherein the sound waves are generated by the periodic compression of the compressible injection fluid in the fluid oscillator device.

23. The method of claim 18, wherein the flow rate varies in a periodic manner over time.

24. The method of claim 18, wherein directing at least a first portion of the compressible injection fluid within the fluid oscillator device to perturb a flow of at least a second portion of the compressible injection fluid within the fluid oscillator device comprises directing at least the first portion of the compressible injection fluid within the fluid oscillator device to perturb a direction of the flow of at least the second portion of the compressible injection fluid within the fluid oscillator device.

25. The method of claim 18, further comprising producing fluids of the subterranean formation to the surface.

26. The method of claim 18, the working fluid is communicated into the formation via perforations.

27. The method of claim 18, wherein injecting the portion of compressible injection fluid into the subterranean formation comprises injecting the portion of compressible injection fluid into the subterranean formation through perforations defined in a casing in the wellbore.

28. The method of claim 18, wherein the fluid oscillator device is installed in a fixed location in the wellbore.

29. The method of claim 18, further comprising sealing an axial section of the wellbore, the fluid oscillator device residing in the sealed axial section.

30. A method comprising:

directing a working fluid comprising a liquid through at least a portion of a wellbore defined in a subterranean formation and into a fluid oscillator device installed in the wellbore;

vaporizing at least a portion of the liquid to form a compressible working fluid; and directing at least a portion of the compressible working fluid out of the fluid oscillator at a flow rate that varies over time.

31. The method of claim 30, further comprising directing at least a first portion of the compressible working fluid within the fluid oscillator device to perturb a flow of at least a second portion of the compressible working fluid within the fluid oscillator device.

32. The method of claim 30, wherein vaporizing at least a portion of the liquid comprises reducing the pressure of the liquid to induce a liquid to gas phase change of the liquid working fluid.

33. The method of claim 30, wherein the liquid comprises condensed water and the compressible working fluid comprises steam.

34. The method of claim 30, further comprising producing fluid of the subterranean formation to the surface.

* * * * *